US006729720B2

(12) United States Patent
Miki et al.

(10) Patent No.: US 6,729,720 B2
(45) Date of Patent: May 4, 2004

(54) IMAGE FORMING APPARATUS HAVING SUCTION HOLES FORMED IN GROOVES OF THE PAPER SUPPORTING SURFACE

(75) Inventors: Motoharu Miki, Hachioji (JP); Yukitaka Kumagai, Iruma (JP); Nobuyuki Koyama, Hachioji (JP); Yasuo Murata, Chofu (JP); Mineo Hashimoto, Hachioji (JP); Masahiro Nakanishi, Ome (JP)

(73) Assignee: Olympus Optical Co., Ltd., Tokyo (JP)

( * ) Notice: Subject to any disclaimer, the term of this patent is extended or adjusted under 35 U.S.C. 154(b) by 0 days.

(21) Appl. No.: 10/174,071

(22) Filed: Jun. 17, 2002

(65) Prior Publication Data

US 2002/0167578 A1 Nov. 14, 2002

Related U.S. Application Data

(63) Continuation-in-part of application No. PCT/JP00/09045, filed on Dec. 20, 2000.

(30) Foreign Application Priority Data

| | | |
|---|---|---|
| Dec. 20, 1999 | (JP) | 11-361228 |
| Aug. 4, 2000 | (JP) | 2000-236324 |
| Nov. 30, 2000 | (JP) | 2000-366040 |
| Dec. 12, 2000 | (JP) | 2000-377867 |

(51) Int. Cl.[7] ..... B41J 2/01
(52) U.S. Cl. ..... 347/104
(58) Field of Search ..... 347/104, 101, 347/105, 106, 123, 242, 262, 264; 400/578; 226/10; 399/361; 346/134; 271/3.01, 3.14, 99, 90

(56) References Cited

U.S. PATENT DOCUMENTS 6,030,069 A * 2/2000 Wakahara et al. ..... 347/55

FOREIGN PATENT DOCUMENTS

| | | | |
|---|---|---|---|
| JP | 3-29352 | U | 3/1991 |
| JP | 7-25083 | A | 1/1995 |
| JP | 8-072337 | A | 3/1996 |
| JP | 8-156351 | A | 6/1996 |
| JP | 9-052395 | A | 2/1997 |
| JP | 9-220837 | A | 8/1997 |
| JP | 10-157229 | A | 6/1998 |
| JP | 10-175341 | A | 6/1998 |
| JP | 10-315551 | A | 12/1998 |

* cited by examiner

*Primary Examiner*—Raquel Yvette Gordon
(74) *Attorney, Agent, or Firm*—Frishauf, Holtz, Goodman & Chick, P.C.

(57) ABSTRACT

An image forming apparatus has a paper support unit for supporting paper carried by a paper carrying unit and an image forming unit for forming an image on the paper, the support unit having a plural grooves formed in its paper support surface along the paper carrying direction and a plural suction holes formed in the groove, and positions of the suction holes in two adjacent grooves being staggered in the paper carrying direction. Alternatively, the support unit includes a first surface portion on which both ends of the paper in the paper widthwise direction are slid and a second surface portion on which an intermediate portion of the paper between the both ends is slid, a length of a paper sliding surface of the first surface portion along the paper carrying direction is set longer than that of the second surface portion.

21 Claims, 21 Drawing Sheets

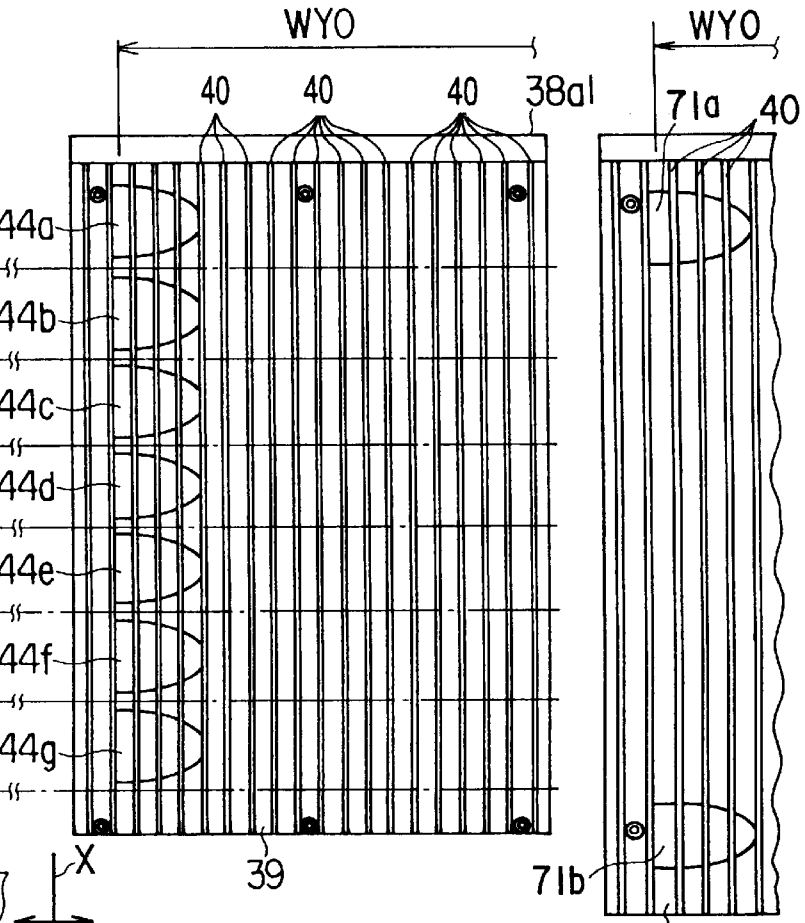
FIG. 22
FIG. 7B
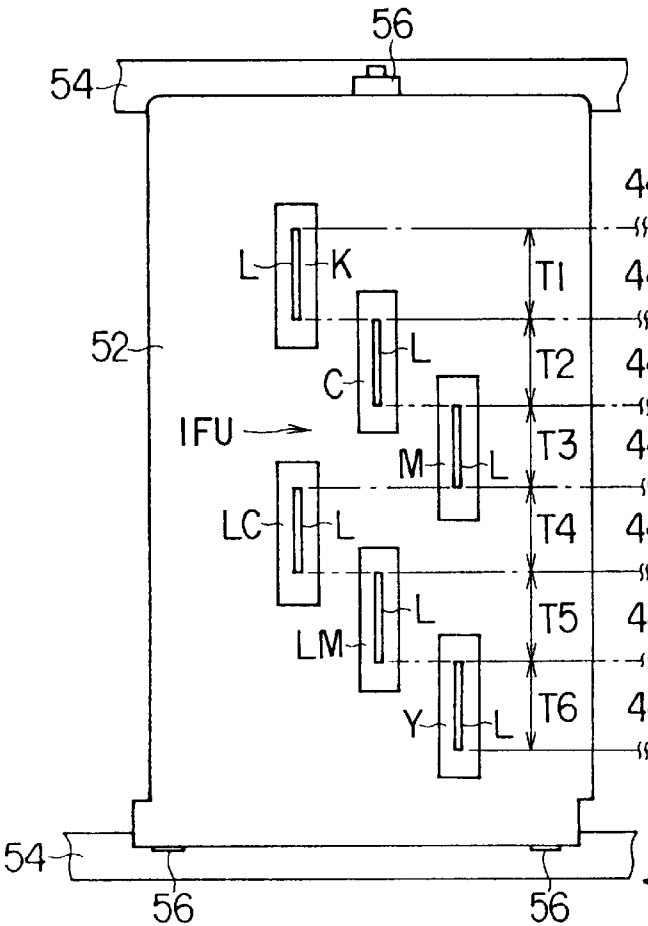
FIG. 7A

IMAGE FORMING APPARATUS HAVING SUCTION HOLES FORMED IN GROOVES OF THE PAPER SUPPORTING SURFACE

CROSS REFERENCE TO RELATED APPLICATIONS

This is a Continuation-in-Part Application of PCT Application No. PCT/JP00/09045, filed Dec. 20, 2000, which was not published under PCT Article 21(2) in English.

This application is based upon and claims the benefit of priority from the prior Japanese Patent Applications No. 11-361228, filed Dec. 20, 1999; No. 2000-236324, filed Aug. 4, 2000; No. 2000-366040, filed Nov. 30, 2000; and No. 2000-377867, filed Dec. 12, 2000, the entire contents of all of which are incorporated herein by reference.

BACKGROUND OF THE INVENTION

1. Field of the Invention

The present invention relates to an image forming apparatus, and more particularly to an image forming apparatus including: a paper carrying unit which carries paper; a paper support unit which has a paper support surface and supports the paper being carried by the paper carrying unit by the paper support surface; and an image forming unit which is arranged on the opposite side of the paper support surface of the paper support unit with respect to the paper and forms an image on the paper being carried by the paper carrying unit.

2. Description of the Related Art

In an image forming apparatus, an image forming unit forms a desired image on a sheet of paper supported on a paper support surface of a paper support unit. In order to improve the quality of an image to be formed, a distance between the paper supported on the paper support surface of the paper support unit and the image forming unit must be maintained constant (for example, 1 to 2 mm, or more preferably within 1 mm).

In particularly, in an ink-jet printer which is one type of the image forming apparatus and uses an ink-jet head as the image forming unit, the paper must be prevented from being lifted above the power support surface in addition to maintaining the distance between the paper and the ink-jet head constant. That is because the lifted paper is brought into contact with the ink-jet head if the paper is lifted above the paper support surface, which results in a factor of paper jam or a damage to an ink nozzle of the ink-jet head.

Jpn. Pat. Appln. KOKAI Publication No. 8-156351 and Jpn. Pat. Appln. KOKAI Publication No. 9-220837 disclose an ink-jet printer in which a plurality of elongated openings or a plurality of grooves which extend in the paper carrying direction are formed on a paper support surface of a platen. Further, these publications disclose that an air suction unit sucks the paper to the paper support surface through the plurality of elongated openings or a plurality of grooves and the paper is prevented from being lifted above the paper support surface.

In the paper support unit disclosed in the above two publications, however, the large suction force can not be caused to act on the paper until the paper closes all of the plurality of openings or the plurality of grooves. In order to prevent the paper from being lifted from the power support surface, a quantity of air suction of the air suction unit must be increased, thereby deteriorating the energy efficiency. Furthermore, when a quantity of air suction of the air suction unit is too large, the resistance between the paper support surface and the paper becomes large, and a quantity of carrying the paper by the paper carrying unit may become inappropriate or paper jam may occur.

In view of the above-described drawbacks, it is a first object of the present invention to provide an image forming apparatus which prevents a sheet of paper from being lifted above a paper support surface of a paper support unit. It is another object of the present invention to provide an image forming apparatus having the excellent energy efficiency of a paper carrying unit.

In the field of the image forming apparatus, improvement in an image forming speed is a permanent problem. One solution of this problem in the ink-jet printer is extension of a length of the ink-jet head in the paper carrying direction. Moreover, with lengthening of the ink-jet printer, a length of a platen in the paper carrying direction must be also increased.

When a long platen is used, however, the possibility that the paper is lifted from a recording range on the paper support surface is increased.

As factors of occurrence of this problem, the following can be considered.

(1) The remaining stress generated when uniformly cutting the paper to a predetermined width dimension in a manufacturing process, is actualized at both ends of the paper in the widthwise direction, and the paper extends along the paper carrying direction.

In addition, the paper extends along the paper carrying direction due to, e.g., an impact of moisture absorption. At this moment, extension in the paper carrying direction generated at the both ends of the paper in the widthwise direction is larger than extension in the paper carrying direction generated at the central part of the paper in the widthwise direction. As a result, the wavelike swell which makes progress in the paper carrying direction is generated at the both ends of the paper in the widthwise direction. This is a factor of occurrence of lift of the paper at the both ends in the paper widthwise direction.

(2) When the length of the platen in the paper carrying direction of the paper support surface is long and an area of the paper support surface becomes large, a supported area of the paper supported by the paper support surface is enlarged. As a result, paper lift generated at the both ends of the paper in the widthwise direction becomes very large. It is hard to cause the lifted part of the paper to be appressed against the paper support surface by only the suction force of the air suction unit. Additionally, since the length of the paper support surface in the paper carrying direction is long, it is also difficult to move the lifted part of the paper to any position other than the recording range on the paper support surface.

(3) As to the paper lift generated at the both ends of the paper in the widthwise direction, since a convex portion of the wavelike swell extends along the paper widthwise direction (see FIG. 10A and FIG. 10B), the paper lift can not be effectively sucked by the ink-jet printer disclosed in the above two publications.

That is, in the platen disclosed in the above two publications, since the plurality of openings or the plurality of groove are formed along the paper carrying direction, the paper lift that the convex portion of the wavelike swell is generated in the paper carrying direction can be effectively sucked, but the paper lift that the convex portion of the wavelike swell is generated along the paper widthwise direction can not be effectively sucked.

In view of the above-described problems, it is a second object of the present invention to provide an image forming apparatus which prevents both ends of paper from being lifted above a paper support surface of a paper support unit even if wavelike swell is generated along the paper carrying direction at the both ends of the paper in the widthwise direction.

BRIEF SUMMARY OF THE INVENTION

To achieve the first object, according to the present invention, there is provided a first image forming apparatus including a paper support unit which has a paper support surface supporting paper, the paper support unit comprising:

a plurality of grooves formed along the paper carrying direction; and a plurality of suction holes respectively formed to each of the plurality of grooves, wherein positions of the plurality of suction holes in two adjacent grooves in the plurality of grooves are staggered in the paper carrying direction.

An end of the paper carried on the paper support surface covers the suction holes of one groove in the adjacent grooves, and the paper is thereby sucked to the paper support surface. Further, when the paper is carried, the end of that paper covers the suction holes of the other groove, and the papery is thereby sucked to the paper support surface. That is, before the paper reaches the lower end of the paper support surface, the paper is sucked alternately by the plurality of suction holes arranged in the adjacent groove so as to be staggered in the vertical direction, thereby preventing the paper from being lifted.

Furthermore, in order to achieve the first object, according to the present invention, there is provided a second image forming apparatus, wherein a chamber constituting a suction unit which sucks the paper to the paper support surface is divided into a plurality of parts in the paper carrying direction.

The end of the paper carried on the paper support surface is first sucked on the paper support surface by the chamber on the upstream side. Then, when the paper is further carried, the end of the paper is sucked on the paper support surface by the chamber on the downstream side. That is, with increase in an area of the paper supported on the paper support surface, a chamber to be used can be changed. Therefore, the paper can be prevented from being lifted above the paper support surface, and the energy efficiency of paper carriage can be improved.

Moreover, in order to achieve the first object, according to the present invention, there is provided a third image forming apparatus, wherein there is provided a control unit which controls a suction negative pressure generated by the suction unit which sucks the paper onto the paper support surface.

Therefore, the paper can be efficiently sucked on the paper support surface without causing the paper to be lifted above the paper support surface.

In addition, in order to achieve the second object, according to the present invention, there is provided a fourth image forming apparatus, wherein the paper support unit has a first paper support surface portion which supports both ends of the paper in the widthwise direction and a second paper support portion which supports a central part of the paper in the widthwise direction, and wherein a percentage of a length L1 of the first paper support surface portion in the paper carrying direction relative to a length L0 of the paper support unit in the paper carrying direction is set larger than a percentage of a length L2 of the second paper support surface portion in the paper carrying direction relative to the length L0 of the paper support unit in the paper carrying direction.

A cause of generation of the paper lift is a fact that the length in the paper carrying direction at the both ends of the paper in the widthwise direction and in the vicinity of the both ends is longer than the length in the paper carrying direction at the central part of the paper in the widthwise direction and the paper support surface of the paper support unit is flat irrespective of generation of the wavelike swell which makes progress along the paper carrying direction at the both ends of the paper in the widthwise direction.

Accordingly, as described above, the paper lift can be prevented by extending the length in the paper carrying direction by forming, e.g., a plurality of convex portions on the first paper support surface portion, and by sucking the extension generated at the end of the paper in the widthwise direction, i.e., the wavelike swell into the convex portions.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

FIG. 7A is a schematic front view of a carriage which holds a plurality of ink-jet heads which function as an image forming unit in the primary part of the image forming apparatus illustrated in FIG. 5;

FIG. 7B is a schematic front view showing a platen block arranged at one end in the horizontal direction orthogonal to a paper carrying direction on the platen depicted in FIG. 6 in a plurality of platen blocks constituting the platen illustrated in FIG. 2 in association with a position in the vertical direction which is relative to the carriage shown in FIG. 7A;

FIG. 22 is a schematic front view showing primary parts of a platen block of an image forming apparatus according to a 14th embodiment of the present invention.

DETAILED DESCRIPTION OF THE INVENTION

Various embodiments and modifications of an image forming apparatus according to the present invention will now be described in detail with reference to the accompanying drawings.

(First Embodiment)

Figure 1:
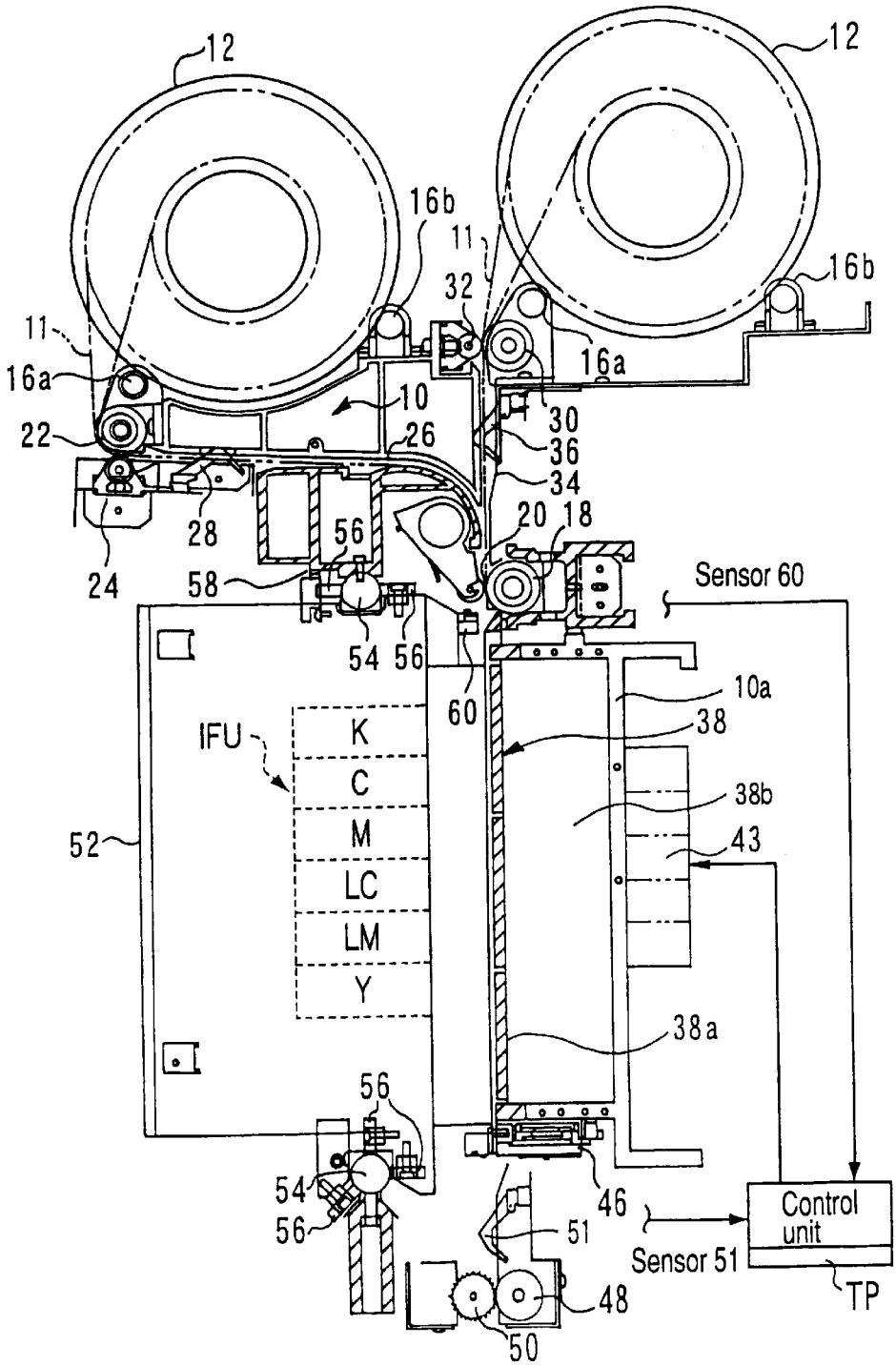
FIG. 1 is a schematic vertical cross-sectional view showing primary parts of an image forming apparatus according to a first embodiment of the present invention.
Figure 2:
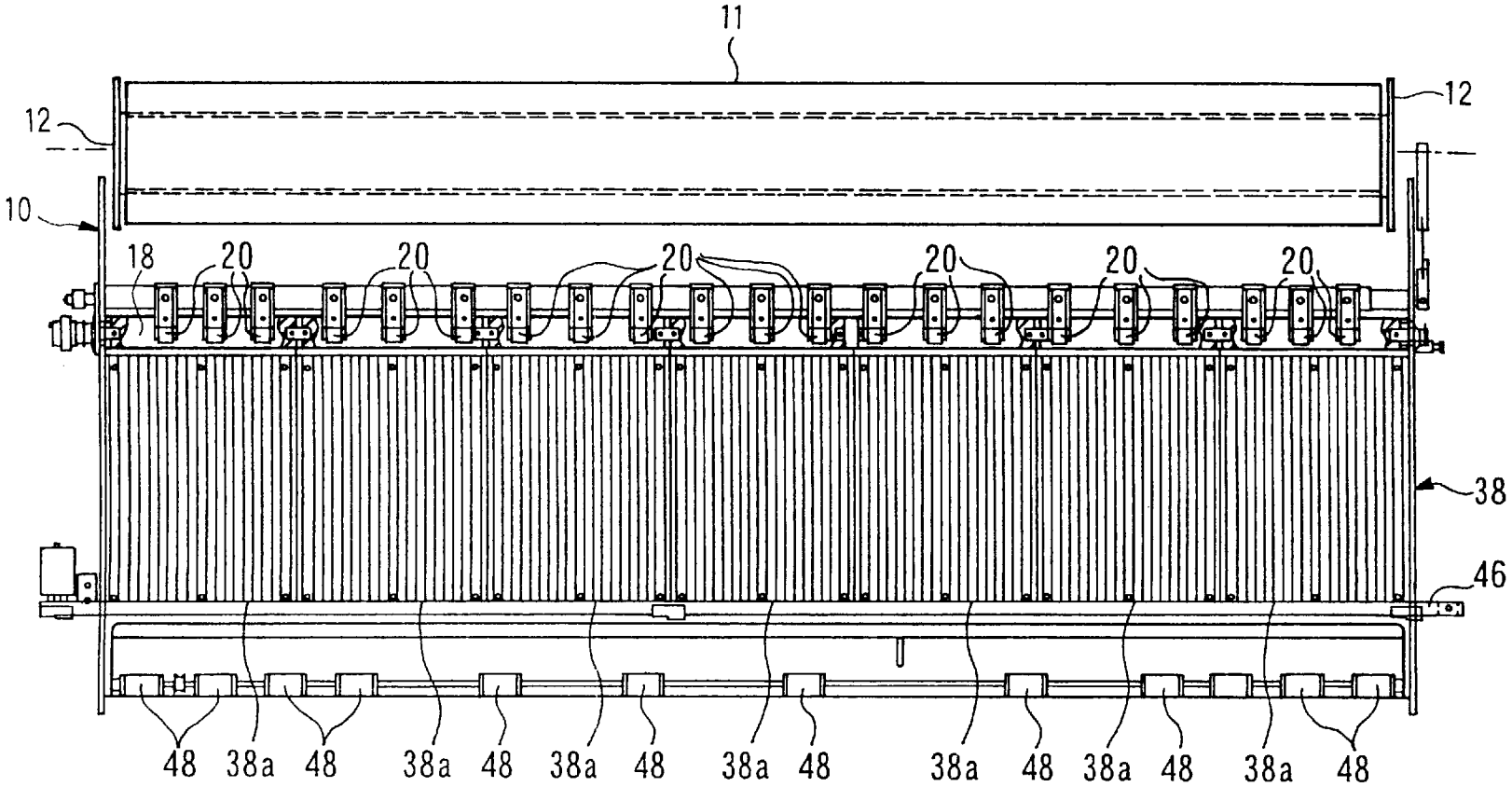
FIG. 2 is a front view showing a paper fed roller, a carrying roller constituting a part of a carrying unit, a platen constituting a paper support unit, and a paper ejection roller constituting a part of a paper carrying unit in the image forming apparatus illustrated in FIG. 1.
Figure 3A:
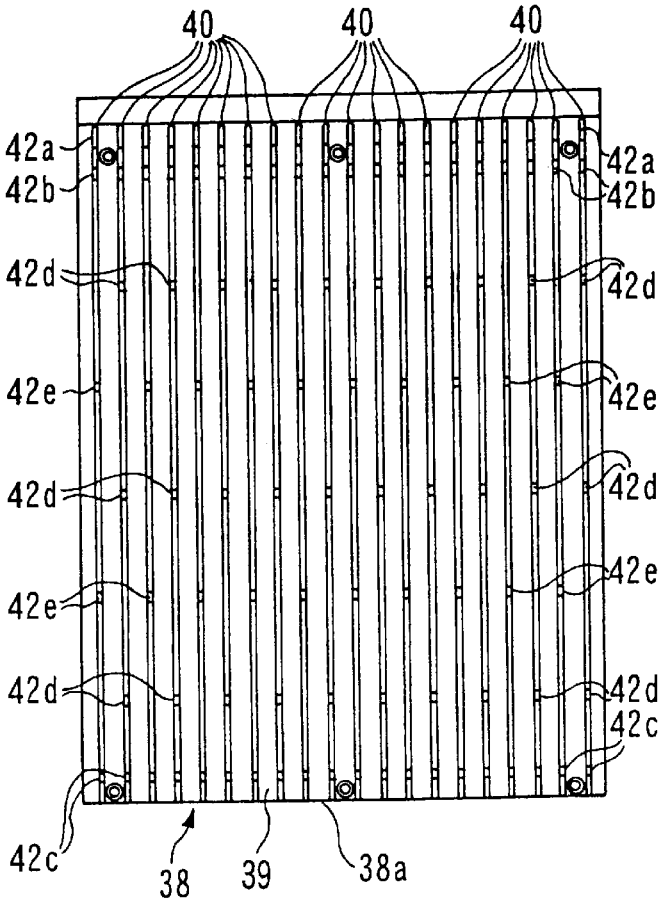
FIG. 3A is an enlarged front view showing one of a plurality of platen blocks constituting the platen depicted in FIG. 2.
Figure 3B:
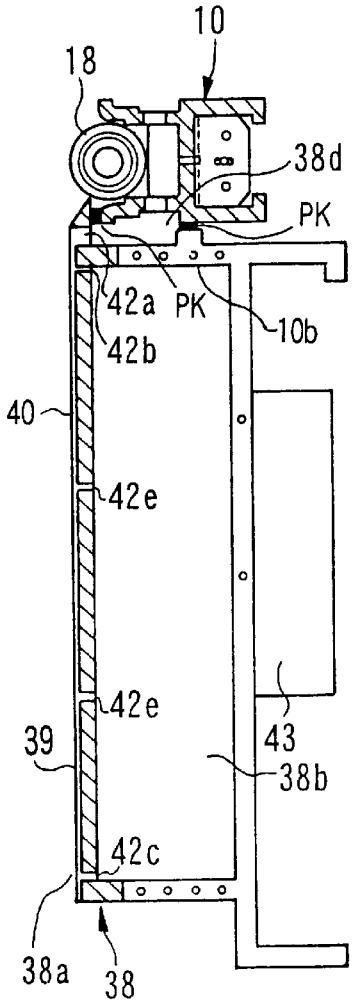
FIG. 3B is a schematic vertical cross-sectional view showing the platen block illustrated in FIG. 3A and the carrying roller adjacent to and provided above this platen block, shown in FIG. 2.

Referring to FIGS. 1 to 3, an image forming apparatus according to a first embodiment of the present invention will be first described in detail. It is to be noted that FIG. 1 is a schematic vertical cross-sectional view showing primary parts of the image forming apparatus according to the first embodiment of the present invention; FIG. 2 is a front view of a paper feed roller, a carrying roller constituting a part of a paper carrying unit, a platen constituting a paper support unit, and a paper ejection roller constituting a part of the paper carrying unit in the image forming apparatus illustrated in FIG. 1; FIG. 3A is an enlarged front view showing one of a plurality of platen blocks constituting the platen depicted in FIG. 2; and FIG. 3B is an enlarged schematic cross-sectional view of the platen block in FIG. 3A and the carrying roller in FIG. 2 which is adjacent to and provided above this platen block.

The image forming apparatus according to the first embodiment is an ink-jet printer.

As shown in FIGS. 1 and 2, the image forming apparatus according to the first embodiment holds two rolls of paper, to which a pair of paper tube holders 12 are attached at their both ends, so as to be separated from each other in parallel in the front-and-back direction (horizontal direction in FIG. 1) above a support frame 10. A long sheet of paper 11 is wound around each of the two rolls of paper. The two rolls of paper are respectively rotatably mounted on a pair of roll paper support rollers 16*a* and 16*b* through a pair of the paper tube holders 12 at the both ends. One of the two roll paper support rollers 16*a* and 16*b* is connected to a non-illustrated rotary encoder in order to be aware of a remaining quantity of the paper 11 in each of the two rolls of paper.

A nip point between a carrying roller 18 and a carrying pinch roller 20 constituting a part of the paper carrying unit is arranged below the space between the two rolls of paper. In this embodiment, the carrying roller 18 is configured to have a warhead shape, a semi-elliptic shape or semicircular shape by one roller having a length in the longitudinal direction slightly larger than a width of the long sheet of paper 11, and can be rotated in a predetermined direction at a predetermined speed by well-known driving means such as a non-illustrated motor. The carrying pinch roller 20 includes a plurality of pinch roller members which are separated from each other at predetermined intervals in the widthwise direction of the long sheet of paper 11.

The paper 11 of the roll paper on the front side (left side in FIG. 1) is drawn out to the nip point between the carrying roller 18 and the carrying pinch roller 20 through a nip point between a front paper feed roller 22 and a front pinch roller 24 set at the front end of the support frame 10 and also through a front paper guide path 26 in the support frame 10. The front paper feed roller 22 can be rotated in a predetermined direction at a predetermined speed by well-known driving means such as a non-illustrated motor. A front paper feed sensor 28 which detects presence/absence of the paper 11 in the front paper guide path 26 is arranged in the front paper guide path 26.

The paper 11 on the roll paper on the rear side (right side in FIG. 1) is drawn out to the front side, i.e., a position directly above the nip point between the carrying roller 18 and the carrying pinch roller 20 through a nip point between a rear paper feed roller 30 and a rear pinch roller 32 set at the central portion of the support frame 10 and also through a rear paper guide path 34 in the support frame 10. The rear paper feed roller 30 can be likewise rotated in a predetermined direction at a predetermined speed by well-known driving means such as a non-illustrated motor. A rear paper feed sensor 36 which detects presence/absence of the paper 11 in the rear paper guide path 34 is arranged in the rear paper guide path 34.

Further, to the support frame 10 is arranged a platen 38 which functions as a paper support unit on the rear side below the nip point between the carrying roller 18 and the carrying pinch roller 20. The front surface of the platen 38 two-dimensionally spreads in the vertical and horizontal directions, and has a length in the horizontal direction, i.e., a width slightly larger than the width of the paper 11. In this embodiment, the platen 38 is constituted by mutually combining in the horizontal direction a plurality of platen blocks 38*a* having the same dimension and shape.

Giving more detailed description, the plurality of platen blocks 38*a* are detachably fixed to a platen stay 10*a*, which is fixed to the support frame 10, by well-known fixing means such as set screws. The surface of the platen stay 10*a* on the outermost side is covered with an air-tight material, and constitutes a platen chamber 38*b* between the platen stay 10*a* and the plurality of platen blocks 38*a* fixed to the platen stay 10*a*.

On the front surface of each of the plurality of platen blocks 38*a*, a plurality of grooves 40 extending in the vertical direction are formed at predetermined intervals in the horizontal direction so as to be parallel to each other. A width in the horizontal direction of each of the plurality of grooves 40 is set to 20-fold or lower of the thickness of the paper having the smallest width used in this image forming apparatus.

To each of the plurality of grooves 40 are formed plurality of suction through holes 42*a*, 42*b*, 42*c*, 42*d* and 42*e* so as to be separated from each other in the extending direction of the groove 40. Incidentally, in FIG. 3A, not all the suction through holes of each of a plurality of grooves 40 are denoted by reference numerals 42*a*, 42*b*, 42*c*, 42*d* or 42*e*, and only some of these suction through holes are designated by reference numerals 42*a*, 42*b*, 42*c*, 42*d* or 42*e* in order to avoid vexatious complication of the drawing.

To the platen stay 10*a* is provided a suction fan 43 which functions as a suction unit in order to form the negative pressure in the platen chamber 38*b*.

Arrangement of a plurality of suction through holes 42*a*, 42*b*, 42*c*, 42*d* and 42*e* of each of the plurality of grooves 40 in the platen 38 will now be described in detail. The suction through hole 42*a* is formed to each of the plurality of grooves 40 at the upper end thereof in the extending direction. The suction through holes 42*a* are mutually linearly arranged in the horizontal widthwise direction of the platen block 38*a*, namely, the horizontal widthwise direction of the platen 38. The back side of these suction through holes 42*a* is positioned on the outer side of the platen stay 10*a*, i.e., the outer side of the platen chamber 38*b*. A sub platen chamber 38*d* is constituted on the back side of the suction through holes 42*a*. This sub platen chamber 38*d* is constituted by the rear surface of the upper end of the platen block 38*a* and the upper end surface of the platen stay 10*a* being pressed against a part of the support frame 10, which supports the carrying roller 18 above the upper end of the platen block 38*a*, through a sealing member PK. The sub platen chamber 38*d* is caused to communicate with the platen chamber 38*b* through an opening formed on the upper end surface of the platen stay 10*a*.

The second suction through hole 42*b* which is the second hole from the upper end is formed to each of the plurality of grooves 40 at a position separated downwards from the suction through hole 42*a* by a predetermined distance. As similar to the above-described suction through holes 42*a*, the suction through holes 42*b* are also mutually linearly arranged in the horizontal widthwise direction of the platen block 43*a*, i.e., the horizontal widthwise direction of the platen 38*a*. The suction through holes 42*b* and all the suction through holes 42*c*, 42*d* and 42*e* which are positioned below the suction through holes 42*b* are all caused to communicate with the platen chamber 38*b*.

The suction through hole 42*c* is formed to each of the plurality of grooves 40 in the vicinity of the lower end thereof. As similar to the above-described suction through holes 42*a*, the suction through holes 42*c* are likewise mutually linearly arranged in the horizontal widthwise direction of the platen block 38*a*, i.e., the horizontal widthwise direction of the platen 38.

In each of tile plurality of grooves 40, the plurality of suction through holes 42*d* and 42*e* are formed between the suction through hole 42*b* which is the second from the upper end and the suction though hole 42*c* in the vicinity of the lower end at predetermined intervals in the vertical direction. The positions of the suction through holes 42*d* and 42*e* are staggered in the vertical direction in two adjacent grooves 40. In this embodiment, the plurality of suction through holes 42*e* of one of the two adjacent grooves 40 are placed at positions corresponding to the intermediate part of the vertical interval of the plurality of suction through holes 42*d* in the other groove 40.

On the front surface of the platen block 38*a*, an area other than the plurality of grooves 40 constitutes a flat paper support surface 39 which two-dimensionally spreads in the vertical and horizontal directions as mentioned above. The paper support surface 39 has been subjected to friction reduction processing. In this embodiment, the friction reduction processing is, e.g., coating of fluorocarbon resin such as Teflon (trademark).

A paper cutter 46 is attached at the lower end of the platen stay 10*a*, and a nip point between a paper ejection roller 48 and a paper ejection pinch roller 50 is arranged directly below the paper cutter 46. Furthermore, a paper ejection sensor 51 is arranged between the paper cutter 46 and the paper ejection roller 48.

A carriage 52 which supports an image forming unit IFU including a plurality of ink-jet heads K, C, M, LC, L, M and Y having a predetermined arrangement for full-color image formation is arranged in front of the platen 38. The plurality of ink-jet heads K, C, M, LC, LM and Y include a plurality of non-illustrated ink cartridges accommodating therein a plurality of types of ink having different densities such as black, cyan, magenta, light cyan, light magenta and yellow, and a plurality of non-illustrated ink-jet nozzles which eject the ink supplied from the plurality of ink cartridges toward the paper support surface 39 of the platen 38. The plurality of non-illustrated ink-jet nozzles are arranged with a predetermined alignment so as to be partitioned in the vertical direction in a predetermined order for each ink color in the carriage 52. Moreover, ink ejection openings of the plurality of ink-jet nozzles are arranged on the carriage 52 so as to be separated from the paper support surface 39 of the platen 38 by a predetermined distance (for example, 1 to 2 mm, or more preferably within 1 mm).

The plurality of ink-jet heads K, C, M, LC, LM and Y are divided into a group on the upstream side (ink-jet heads K, C and M) and a group on the downstream side (ink-jet heads LC, LM and Y) in the carrying direction so as not to overlap each other in the paper carrying direction, and sequentially staggered on one side of the paper widthwise direction on the paper support surface 39 in each group (see FIG. 7A). A predetermined number of the multiple ink-jet nozzles of the plurality of ink-jet heads K, C, M, LC, LM and Y are arranged at the same predetermined intervals in the paper carrying direction, and constitute a nozzle string L (see FIG. 7A). In addition, three nozzle strings L of the ink-jet heads K, C and M in the upstream side group are staggered in the paper widthwise direction, and three nozzle strings L of the ink-jet heads LC, LM and Y in the downstream side group are likewise staggered in the paper widthwise direction (see FIG. 7A). However, the three nozzle strings L of the ink-jet heads K, C and M in the upstream side group and the three nozzle strings L of the ink-jet heads LC, LM and Y in the downstream side group are linearly aligned in the paper carrying direction (see FIG. 7A).

Two movement guide rods 54 extending in the widthwise direction of the platen 38 are arranged above and below the carriage 52, and the two movement guide rods 54 are fixed to the support frame 10. The two movement guide rods 54 are arranged so as to be parallel to each other, and also arranged so as to be parallel to the paper support surface 39 on the front surface of the platen 38. The carriage 52 is supported by the two movement guide rods 54 through, e.g., a plurality of guide rollers 56 so as to be capable of moving in a predetermined range along the two movement guide rods 54. A linear encoder 58 which detects a position of the carriage 52 along the two movement guide rods 54 is interposed between the carriage 52 and the upper movement guide rod 54.

The carriage 52 can reciprocate along the two movement guide rods 54 within the above-described predetermined range by non-illustrated reciprocation driving means. Additionally, a paper end detection sensor 60 is arranged at a position corresponding to the upper end of the front surface of the platen 38 on the rear side of the carriage 52.

In the image forming apparatus according to the first embodiment of the present invention having the above-described structure, the paper 11 on the front roll paper is pulled out to the nip point between the carrying roller 18 and the carrying pinch roller 20 through the nip point between the front paper feed roller 22 and the front pinch roller 24 and the front paper guide path 26 before use, and the end of the paper 11 is detected by the paper end detection sensor 60 provided on the carriage 52.

In order to obtain the paper 11 on which a desired full-color image is formed, the paper 11 which is nipped by the carrying roller 18 and the carrying pinch roller 20 and drawn from the front roll paper is led to a gap between the ink-jet heads and the front surface of the platen 38, namely, the paper support surface 39 of the platen block 38*a* by intermittently rotating the carrying roller 18 at a predetermined speed at predetermined intervals. Further, at the same time, a suction fan 43 of the platen 38 is operated.

As a result, the paper 11 which has reached the upper end of the paper support surface 39 of the platen block 38*a* is relatively strongly sucked onto the paper support surface 39 through the plurality of suction through holes 42*a* at the upper ends of the plurality of grooves 40 and the plurality of suction through holes 42*b* which are the second from the upper end. This relatively strong suction makes the habit of curling flat which has been formed in the paper 11 when the paper 11 has been wound around the roll paper for a long period of time. The paper 11 does not generate the strong frictional force between itself and the paper support surface 39 owing to the friction reduction processing on the paper support surface 39 irrespective of this relatively strong suction, and is intermittently carried toward the lower end of the front surface of the platen 38 at a predetermined speed at predetermined intervals by rotation of the carrying roller 18 nipping the paper 11 in cooperation with the carrying pinch roller 20.

The paper 11 carried on the paper support surface 39 of the platen block 38*a* is sucked onto the paper support surface 39 through the plurality of suction through holes 42*d* and 42*e* arranged so as to be staggered in the vertical direction in the two adjacent grooves 40 before the paper 11 reaches the lower end of the front surface of the platen 38. The paper 11 is prevented from being lifted above the power support surface 39 of this platen block 38*a*.

The plurality of suction through holes 42*a* at the upper ends in the grooves 40 and the plurality of suction through holes 42*b* which are the second from the upper end in the plurality of grooves 40 are respectively arranged along two virtual lines extending in the horizontal widthwise direction at two positions separated from each other in the vertical direction. Furthermore, the plurality of suction through holes 42*d* and 42*e* are also respectively arranged along the two virtual lines extending in the horizontal widthwise direction at two positions separated from each other in the vertical direction. As compared with the suction force of the plurality of suction through holes 42*a* and 42*b* along the former two virtual lines sucking the paper 11, however, the suction force of the plurality of suction through holes 42*d* and 42*e* along the latter two virtual lines sucking the paper 11 is weak.

That is because a number of the plural suction through holes 42*a* and 42*b* along the former two virtual lines is larger than that of the plural suction through holes 42*d* and 42*e* along the latter two positions.

The suction force of the plurality of suction through holes 42*d* and 42*e* along each of the latter two virtual lines is, however, sufficient for holding the paper 11 flat on the paper support surface 39 of the front surface of the platen block 38*a*.

Furthermore, the width in the horizontal direction of each of the plurality of grooves 40 is set to 20-fold or lower of a thickness of the paper having the minimum thickness, which is planned to be used in the image forming apparatus according to this embodiment. Therefore, on the paper support surface 39 of the front surface of the platen block 38*a*, the paper 11 does not slack at a position corresponding to each of the plurality of grooves 40 without being sucked into each of the plurality of grooves 40.

The force that the plurality of suction through holes 42*c* arranged along one virtual line extending in the horizontal widthwise direction directly above the lower end of the plurality of grooves 40 suck the paper 11 is relatively strong as substantially similar to the force that the plurality of suction through holes 42*a* arranged along one of the former two virtual lines suck the paper 11 or the force that the plurality of suction through holes 42*b* arranged along the other one of the former two virtual lines suck the paper 11.

That is because a number of the multiple suction through holes 42*c* arranged along one virtual line extending in the horizontal widthwise direction directly above the lower end in the vertical direction is substantially equal to a number of the multiple suction through holes 42*a* arranged along one virtual line extending in the horizontal widthwise direction at the upper end position and a number of the multiple suction through holes 42*b* arranged along one virtual line extending in the horizontal widthwise direction at the positions which are the second from the upper end.

This assuredly prevents the tendency of the paper 11 to lift above the paper support surface 39 at the lower end of the paper support surface 39 of the platen block 38*a*, and guarantees that the paper 11 is flatly sucked onto the paper support surface 39 of the platen block 38*a* until it reaches the lower end.

The paper 11 is intermittently carried downwards at predetermined intervals with a predetermined speed while being flatly maintained on the front surface of the platen 38, i.e., the paper support surface 39 of the platen block 38*a* by suction. Moreover, while the paper 11 is stopped on the paper support surface 39 of the platen 38, the carriage 52 reciprocates in the predetermined range along the two movement guide rods 54. When the carriage 52 is reciprocating, a desired full-color image is formed on the paper 11 by the image forming unit IFU on the carriage 52. It is to be noted that data used for forming a desired full-color image by the image forming unit IFU is inputted to the control unit from a non-illustrated external control device connected to the control unit of this image forming apparatus, for example, a computer.

The paper 11 which has passed through the gap between the front surface of the platen 38 and the rear surface of the carriage 52 passes through the paper ejection sensor 51, further moves downwards while being nipped at the nip point between the paper ejection roller 48 and the paper ejection pinch roller 50, and is carried at a predetermined speed. After the paper ejection sensor 51 detects the paper 11 ejected from the gap for a predetermined time, namely, after a predetermined length of the paper 11 moves on the front surface of the platen 38 in order to form a desired image, the paper cutter 46 cuts the paper 11 on which the desired image is formed to a predetermined length.

When the paper 11 on the front roll paper runs out and the front paper feed sensor 28 no longer detects the paper 11, the rear paper feed roller 30 among the rear paper feed roller 30 and the rear paper feed pinch roller 32 which are nipping the paper 11 from the rear roll paper is driven, and the paper 11 is fed toward the nip point between the carrying roller 18 and the carrying pinch roller 20. Nipping of the paper 11 by the carrying roller 18 and the carrying pinch roller 20 moves the paper 11 downwards until the end of the paper 11 is detected by the paper end detection sensor 60, thereby terminating preparation for next image formation.

In the above-described embodiment, although depending on various kinds of factors such as an area of the front surface of the platen 38, a material of the front surface, surface processing, and a type of the paper 11, the paper 11 can be flatly sucked on the front surface of the platen 38 against the habit of curling at the end of the paper 11. It is understood that it is preferable to set a suction negative pressure generated by the suction fan 43 to a range from substantially 0.5 mmHg to 2 mmHg in order to prevent carriage of the paper 11 by nipping by the carrying roller 18 and the carrying pinch roller 20 from being stopped by the suction.

It is to be noted that such an operation portion TP as a touch panel of the control unit according to the first embodiment can be constituted so that the suction negative pressure generated by the suction fan 43 can be changed depending on the type of the paper 11 in the foregoing embodiment.

Incidentally, in the above-described embodiment, in order to eliminate the habit of curling at the end of the paper 11, the suction through holes 42*a* and 42*b* are formed at the upper and the second position from the upper end of all of the plurality of grooves 40 of the platen 38, and a number of the suction through holes arranged on the virtual line extending in the horizontal widthwise direction is large as compared with an area between the second position from the upper and the lower end of the plurality of grooves 40 of the platen 38. However, even if the same number of the suction through holes are formed on each of the plurality of virtual lines extending in the horizontal widthwise direction at a plurality of height positions in the vertical position in all of the plurality of grooves 40 of the platen 38, the similar advantage can be obtained by adopting the following method.

That is, the control unit according to the first embodiment is configured so as to be capable of controlling the suction negative pressure generated by the suction fan 43 in multiple stages. Further, when carriage of the paper 11 is first started from the nip point between the carrying roller 18 and the carrying pinch roller 20, the control unit is caused to control the suction fan 43 in the following manner. That is, before the sufficient time elapses from detection of the end of the paper 11 by the paper end detection sensor 60 to passage of the end of the paper 11 through the upper end of the platen 38, the control unit is caused to control the suction fan 43 so as to increase the suction negative pressure generated by the suction fan 43 relatively high. Thereafter, the control unit is caused to control the suction fan 43 so as to reduce the suction negative pressure generated by the suction fan 43 relatively low.

Alternatively, when carriage of the paper 11 first starts from the nip point between the carrying roller 18 and the carrying pinch roller 20, the control unit is caused to control the suction fan 43 in the following manner. That is, before the end of the paper 14 is detected by the paper ejection sensor 51 after detection of the end of the paper 14 by the paper end detection sensor 60, the control unit is caused to control the suction fan 43 so as to increase the suction negative pressure generated by the suction fan 43 relatively high. Then, the control unit is caused to control the suction fan 43 so as to reduce the suction negative pressure generated by the suction fan 43 relatively low.

As an example of the structure to control the suction negative pressure generated by the suction fan 43 in multiple stages, a quantity of power supplied to the suction fan 43 can be changed in multiple stages by the control unit. Furthermore, as another example of the structure, the plurality of suction fans 43 are set as indicated by chain double-dashed lines in FIG. 1, and a number of the suction fans 43 to be used by the control unit can be changed. In still another example, outputs from the plurality of suction fans 43 set in the platen chamber 38*b* differ from each other, and the suction fans 43 to be used by the control unit can be changed. Moreover, in yet another example, when the ink is injected onto the paper 11 on the front surface of the platen 38 by the image forming unit IFU in order to form a desired image, the suction fan 43 is operated by the control unit, and the paper 11 is sucked onto the front surface of the platen 38. When the paper 11 is carried on the front surface of the platen 38, the operation of the suction fan 43 is weakened or stopped by the control unit.

Description will now be given as to a modification and another modification of the platen and the suction fan constituting the suction unit in the image forming apparatus shown in FIG. 1 with reference to FIGS. 4A and 4B.

Figures 4A, 4B:
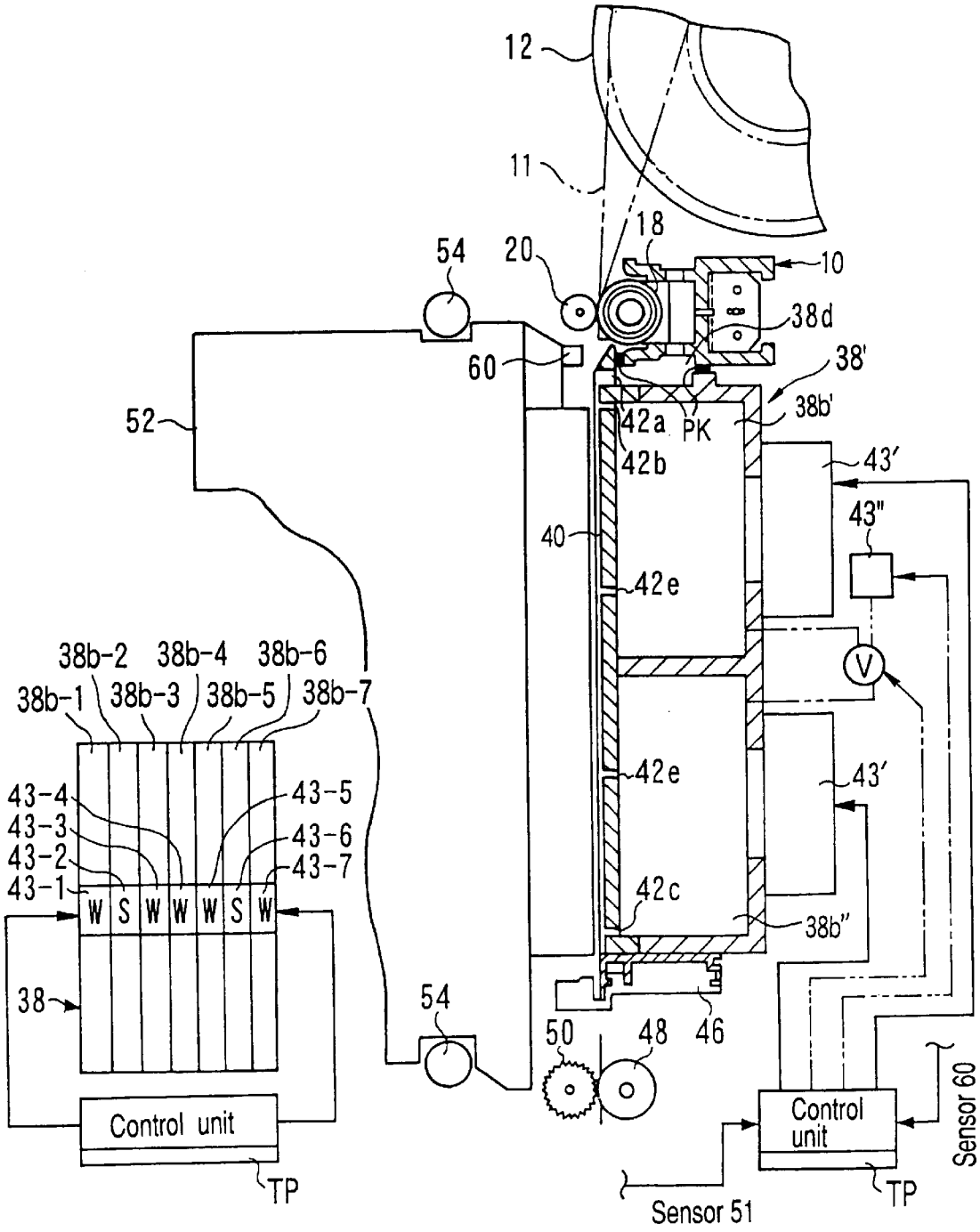
FIG. 4A is a schematic vertical cross-sectional view showing a modification of the platen and a suction fan constituting a suction unit in the image forming apparatus depicted in FIG. 1.
FIG. 4B is a schematic vertical cross-sectional view showing another modification of the platen and the suction fan in the image forming apparatus depicted in FIG. 1.

In the further structure to control the suction negative pressure generated by the suction fan in multiple stages, as schematically shown in FIG. 4A, the platen chamber 38*b* shown in FIG. 1 and FIG. 3B is divided into upper and lower parts (the upstream side and the downstream side in the paper carrying direction), and suction fans 43' and 43' are set in respective sub platen chambers 38*b*' and 38*b*".

In such a structure, when the paper 11 carried on the front surface of the platen 38 by nipping by the carrying roller 18 and the carrying pinch roller 20 passes through an area corresponding to the upper sub platen chamber 38*b*', only the upper suction fan 43' is operated by the control unit. When the paper 14 carried on the front surface of the platen 38 passes through an area corresponding to the upper sub platen chamber 38*c*' and the lower sub platen chamber 38*c*", the lower suction fan 43' is also operated by the control unit in addition to the upper suction fan 43'. Moreover, here, the suction capability of the upper suction fan 43' can be set higher than that of the lower suction fan 43'.

In addition, as indicated by chain double-dashed lines in FIG. 4A, the upper sub platen chamber 38*b*' and the lower sub platen chamber 38*b*" are connected to the common suction fan 43" through a valve, suction is selectively enabled from either or both of the upper sub platen chamber 38*b*' and the lower sub platen chamber 38*b*" by opening/closing of the valve, or the suction capability in either or both of the upper sub platen chamber 38*b*' and the lower sub platen chamber 38*b*" can be adjusted in accordance with the degree of opening of the valve. It is to be noted that the platen chamber 38*b* may be divided into a plurality of sub chambers as well as two sub chambers.

In a further structure for controlling the suction negative pressure generated by the suction fan in multiple stages, as schematically shown in FIG. 4B, the platen chamber 38*b* illustrated in FIG. 1 and FIG. 3B is partitioned into a plurality of, e.g., seven sub chambers in the horizontal widthwise direction, and suction fans 43-1, 43-2, 43-3, 43-4, 43-5, 43-6 and 43-7 controlled by the control unit are set in the respective sub platen chambers 38*b*-1, 38*b*-2, 38*b*-3, 38*b*-4, 38*b*-5, 38*b*-6 and 38*b*-7. Additionally, by arbitrarily setting the suction strength of these suction fans to strong S or weak W by the control unit, the habit of curling at the end of the paper 11 can be broken, and the paper 11 can be most efficiently sucked onto the front surface of the platen 38 so as to be carried.

Here, each of the plurality of sub platen chambers can be operated with a desired timing and desired suction strength in such a manner the habit of curling at the end of the paper 11 can be broken and the paper 11 can be most efficiently sucked onto the front surface of the platen 38 so as to be carried by connecting one suction fan to the plurality of sub platen chambers 38*b*-1, 38*b*-2, 38*b*-3, 38*b*-4, 38*b*-5, 38*b*-6 and 38*b*-7 through a plurality of valves and adjusting opening/closing or a valve opening degree of the plurality of valves by the control unit.

(Second Embodiment)

A second embodiment of the image forming apparatus according to the present invention will now be described in detail with reference to FIGS. 5 to 10B. In this embodiment, the image forming apparatus is likewise an ink-jet recording type ink-jet printer.

Figure 5:
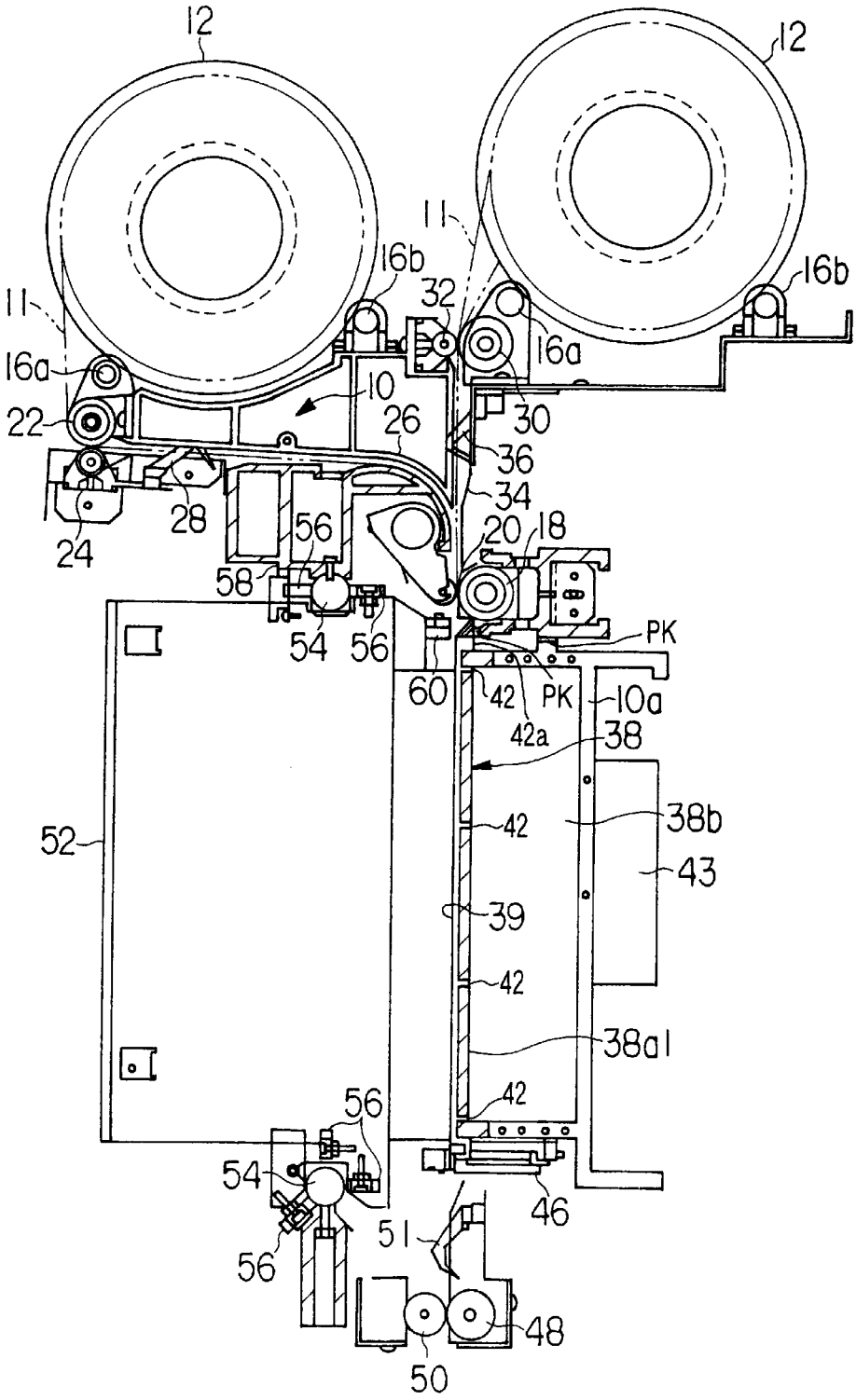
FIG. 5 is a schematic vertical cross-sectional view showing primary parts of an image forming apparatus according to a second embodiment of the present invention.
Figure 6:
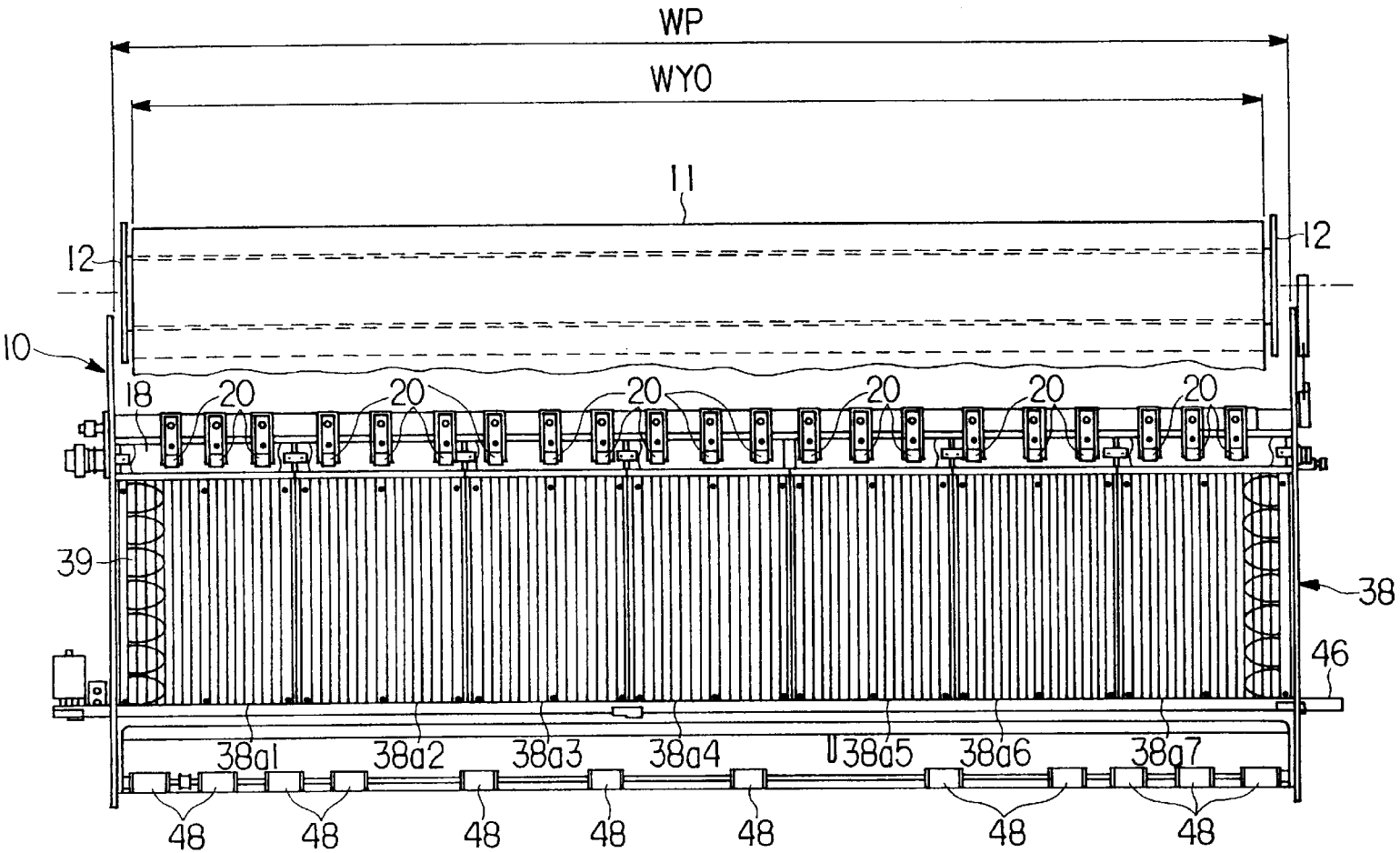
FIG. 6 is a schematic front view showing a platen functioning as a paper support unit in a primary portion in the image forming apparatus depicted in FIG. 5 together with a paper feed roll configured to have a long sheet of paper which is supplied to the platen being wound in the form of a roll, or a carrying roller and a paper ejection roller constituting a carrying unit which is arranged above and below the platen, draws out the long sheet of paper from the paper feed roll and carries it along the platen.
Figure 8B:
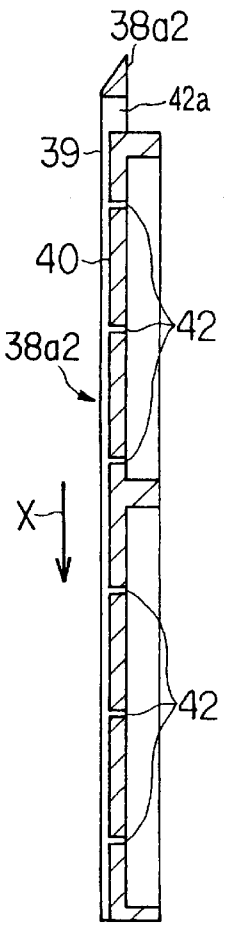
FIG. 8B is a schematic vertical cross-sectional view showing the platen block illustrated in FIG. 8A taken along the line B—B.
Figure 8A:
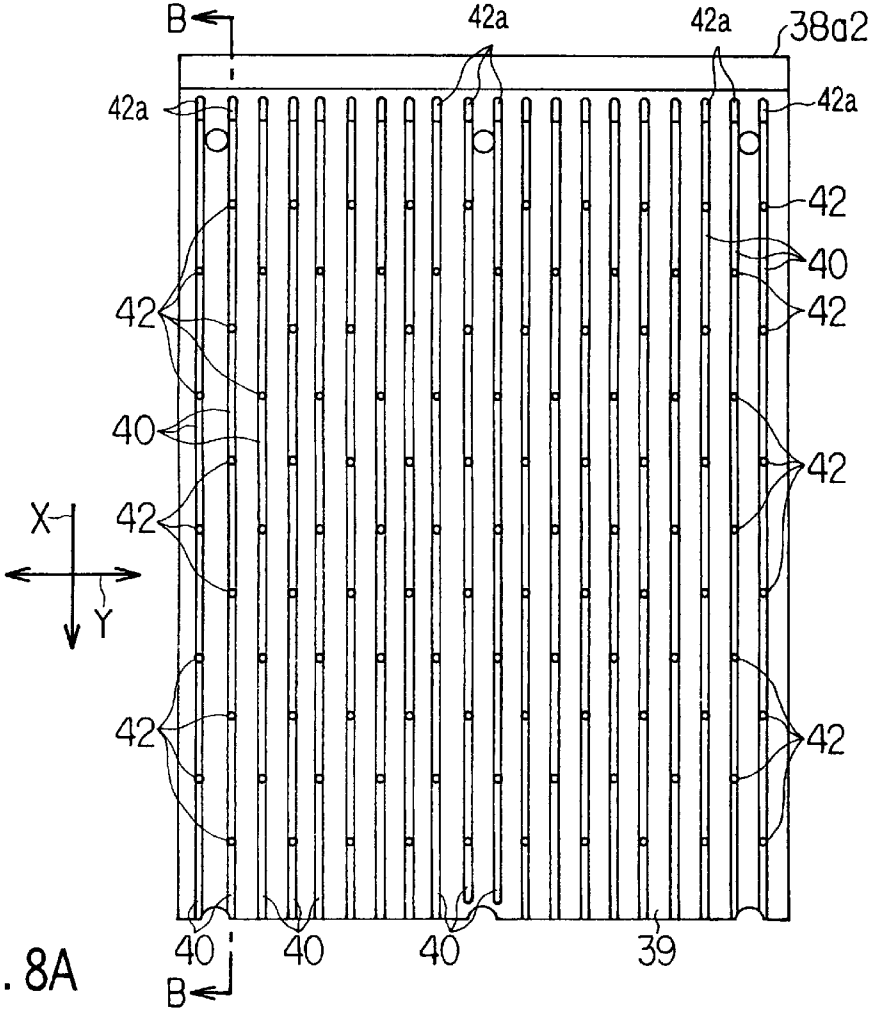
FIG. 8A is an enlarged front view showing a platen block arranged at the center in the horizontal direction orthogonal to the paper carrying direction on the platen depicted in FIG. 6 in the plurality of platen blocks constituting the platen illustrated in FIG. 6.
Figures 9B, 9C:
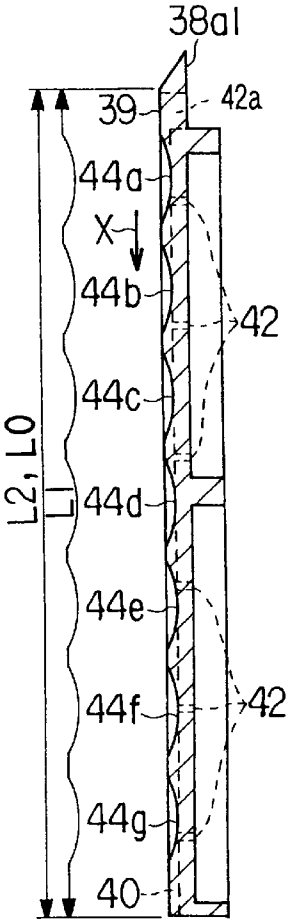
FIG. 9B is a schematic vertical cross-sectional view showing the platen block depicted in FIG. 9A taken along the line B—B.
FIG. 9C is a view comparing, in a paper support surface of the front surface of the platen block illustrated in FIG. 9A, a length L1 in the paper carrying direction along curved low-surface areas of a plurality of concave portions formed in a first paper support surface portion corresponding to one end portion of the paper carried on the paper support surface in the widthwise direction with a length L2 in the paper carrying direction along a linear flat second paper support surface portion which corresponds to an intermediate portion between both ends of the paper carried on the paper support surface in the widthwise direction and does not include a plurality of concave portions.
Figure 9A:
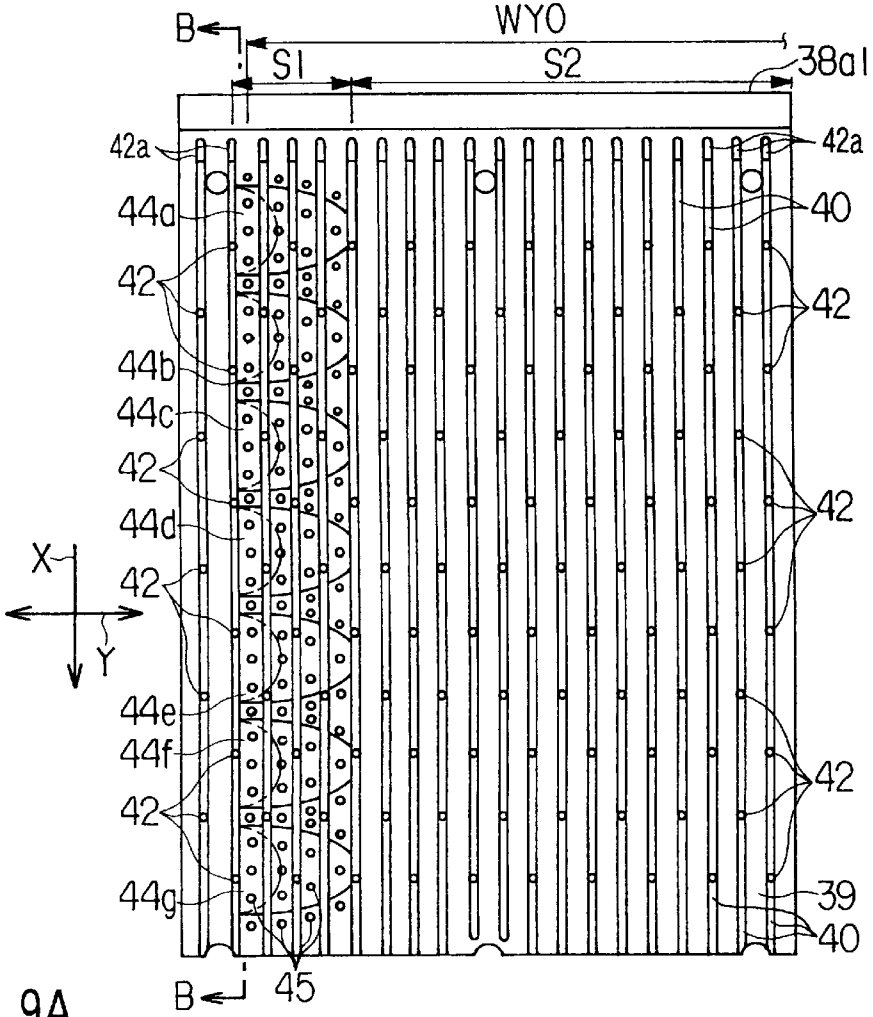
FIG. 9A is an enlarged schematic front view showing the platen block illustrated in FIG. 7B.
Figure 10A:
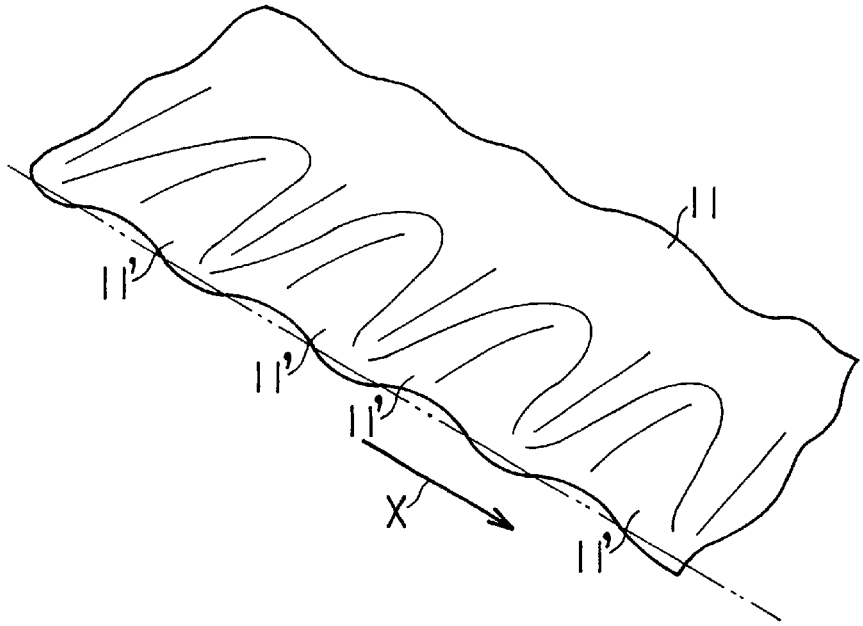
FIG. 10A is an enlarged schematic perspective view showing a typical shape of the swell which is a factor of paper lift along the longitudinal direction of paper generated at both ends in the widthwise direction in a long sheet of paper due to a remaining stress in manufacture of paper which is actualized when uniformly cutting the paper in a predetermined widthwise direction or moisture absorption after manufacture.

FIG. 5 is a schematic vertical cross-sectional view showing primary parts of the ink-jet printer according to the second embodiment; FIG. 6, a schematic front view showing a platen as a paper support unit, a paper feed roll arranged above the platen, and a carrying roller and a paper ejection roller as a carrying unit arranged above and below the platen in the primary parts of the ink-jet printer illustrated in FIG. 5; FIG. 7A, a schematic front view of a carriage which holds six ink-jet heads as an image recording unit in the primary parts of the ink-jet printer illustrated in FIG. 5; FIG. 7B, a schematic front view showing a platen block arranged at the left end in the horizontal direction among seven platen blocks constituting the platen depicted in FIG. 6 in association with the paper carrying direction position which is relative to the carriage illustrated in FIG. 7A; FIG. 8A, an enlarged front view of a platen block arranged at the center in the horizontal direction among the seven platen blocks illustrated in FIG. 6; FIG. 8B, a schematic vertical cross-sectional view taken along the line B—B of the platen block illustrated in FIG. 8A; FIG. 9A, an enlarged schematic front view of the platen block depicted in FIG. 7B; FIG. 9B, a schematic vertical cross-sectional view taken along the line B—B of the platen block depicted in FIG. 9A; FIG. 9C, a view comparing, in the paper support surface of the front surface of the platen block depicted in FIG. 9A, a length L1 in the paper carrying direction including a curved bottom area of each of a plurality of concave portions on a first paper support surface portion corresponding to one end in the widthwise direction of the paper carried on the paper support surface with a length L2 in the paper carrying direction of a linear flat second paper support surface portion which corresponds to a central portion in the widthwise direction of the paper carried on the paper support surface and does not include a plurality of concave portions; FIG. 10A, an enlarged schematic perspective view showing a typical shape of wavelike paper lift (paper lift that the convex portions of paper lift extend in the paper widthwise direction) generated at both ends in the widthwise direction due to a remaining stress in manufacture of the paper which is actualized when uniformly cutting the paper with a predetermined width or moisture absorption after manufacture; and FIG. 10B, an enlarged schematic front view showing a typical shape of swell which is a factor of paper lift illustrated in FIG. 10A.

The structure of the primary parts of the ink-jet printer according to this embodiment is the same as the structure of the primary parts of the ink-jet printer according to the first embodiment described with reference to FIGS. 1 to 3. In the structure of the primary parts of the ink-jet printer according to this embodiment shown in FIGS. 5 and 6, therefore, the same members as those in the structure of the primary parts of the ink-jet printer according to the first embodiment are denoted by the same reference numerals, thereby omitting their detailed explanation.

Two rolls of paper 11 are made of the same material and have the same dimension, and each paper 11 has a width of 1372 mm (54 inches) in this embodiment.

A carrying roller 18 is constituted by one roller which is slightly longer than the width WYO of the paper 11. A carrying pinch roller 20 is pressed toward the carrying roller 18 by non-illustrated impetus giving means.

This embodiment is different from the first embodiment in the structure of a platen 38.

A front surface 39 of the platen 38 two-dimensionally spreads in the paper carrying direction and the paper width direction and, as apparent from FIG. 6, the front surface 39 has a width WP which is slightly longer than the width WYO of the paper 11.

The platen 38 is constituted by combining seven platen blocks 38*a*1 to 38*a*7 in contiguity with each other in the paper widthwise direction (horizontal direction in FIG. 6). The platen blocks 38*a*1 to 38*a*7 are detachably fixed to a platen stay 10*a* fixed to a support frame 10 by well-known fixing means such as set screws. The platen blocks 38*a*1 to 38*a*7 have the same structure except the two platen blocks 38*a*1 and 38*a*7 positioned at both ends in the paper widthwise direction. A large part of the structure of the two platen blocks 38*a*1 and 38*a*7 at the both ends is the same as that of each of the other platen blocks 38*a*2 to 38*a*6. Further, the two platen blocks 38*a*1 and 38*a*7 at the both ends in the paper widthwise direction have a shape which is symmetrical relative to the center in the paper widthwise direction.

The platen stay 10*a* is covered with an airtight material except for a part to which the seven platen blocks 38*a*1 to 38*a*7 are fixed, and constitutes a platen chamber 38*b* between itself and the platen blocks 38*a*1 to 38*a*7 fixed to the platen stay 10*a*. To the platen stay 10*a* is provided a suction fan 43 as a suction unit used for forming a negative pressure in the platen chamber 38*b*.

Furthermore, in this embodiment, as similar to the first embodiment, a combination of a front paper feed roller 22 and a front pinch roller 24, a combination of the carrying roller 18 and the carrying pinch roller 20 and a combination of a paper ejection roller 48 and a paper ejection pinch roller 50 constitute a paper carrying unit for carrying the front roll type paper 11 in a predetermined direction. Moreover, a combination of a rear paper feed roller 30 and a rear pinch roller 32, a combination of the carrying roller 18 and the carrying pinch roller 20 and a combination of the paper ejection roller 48 and the paper ejection pinch roller 50 constitute a paper carrying unit for carrying the rear roll type paper 11 in a predetermined direction.

The structure of the platen 38 will now be described in detail with reference to FIGS. 7A to 9C.

As with the platen block 38*a*2 as a typical example shown in FIGS. 8A and 8B, each of the platen blocks 38*a*2 to 38*a*6 positioned at the center of the platen 38 has a plurality of grooves 40 which extend in parallel to each other in the paper carrying direction X at a plurality of positions at predetermined intervals along the paper widthwise direction Y (horizontal direction in FIG. 8A) orthogonal to the paper carrying direction X (direction from the upper part to the lower part in FIGS. 8A and 8B) on the flat front surface 39. A dimension in the paper widthwise direction Y in each of a plurality of grooves 40, i.e., a groove width is set within 20-fold of a thickness of the paper having a smallest thickness used in this ink-jet printer.

A first suction through hole 42*a* is formed to each of the plurality of grooves 40 at the upstream end of the groove 40 in the paper carrying direction X. These first suction through holes 42*a* are linearly formed on a virtual straight line in the paper widthwise direction Y. It is to be noted that the first suction through hole 42*a* is formed to each of a plurality of grooves 40 at the upstream end in the paper carrying direction X in any other platen blocks and the first suction through holes 42*a* are hence linearly formed in the entire platen 38.

A plurality of second suction through holes 42 are formed to each of the plurality of grooves 40 at the same predetermined intervals in the extending direction of the groove 40 (paper carrying direction). Furthermore, in two adjacent grooves 40, the second suction through hole 42 of one groove 40 is arranged so as to be arranged at substantially the center of the distance between two adjacent second suction through holes 42 in the other groove 40.

Incidentally, in FIGS. 8A and 8B, in order to prevent these drawings from being complicated, not all of the plurality of grooves and the first and second suction through holes are denoted by the corresponding reference numerals 40, 42*a* and 42.

A part of the front surface 39 of the platen block 38*a*2 to which the plurality of grooves 40 are not formed constitutes a power support surface on which the paper 11 is slidingly carried. That is, the front surface 39 excluding the grooves 40 constitutes the paper support surface. Friction reduction processing for reducing friction generated between the paper support surface and the paper 11 slid thereon is applied to the paper support surface, and fluorocarbon resin which is one kind of friction reduction material such as Teflon (registered trademark) is applied on the paper support surface in this embodiment.

Detailed description will now be given as to the structure of the platen block 38*a*1 arranged on the left end of the two platen blocks 38*a*1 and 38*a*7 at the both ends in the paper widthwise direction with reference to FIGS. 7B, 9A and 9B. It is to be noted that constituent parts which function similarly as those in the already described platen block 38*a*2 are denoted by the same reference numerals as those used in description of the platen block 38*a*2, thereby omitting their detailed explanation.

As shown in FIG. 7B, in the platen block 38*a*1, seven concave portions 44*a*, 44*b*, 44*c*, 44*d*, 44*e*, 44*f* and 44*g* are formed in parts corresponding to the left end portions in the paper carrying direction X and the paper widthwise direction Y at a plurality of positions along the paper carrying direction X. As shown in FIG. 7A, among the seven concave portions 44*a* to 44*g*, the six concave portions 44*b* to 44*g* correspond to movement trajectories T1, T2, T3, T4, T5 and T6 of respective nozzle strings L of six ink-jet heads K, C, M, LC, LM and Y when the carriage 52 is moved along the front surface 39 of the platen block 38*a*1, and the concave portion 44*a* is formed in accordance with the upstream side of the movement trajectory T1 of the nozzle string L of the ink-jet head K which is provided on the most upstream side in the paper carrying direction X.

These concave portions 44*a* to 44*g* have the same shape and dimension. As well illustrated in FIG. 9A, the shape of the front surface 39 seen from the front side is gradually opened towards the outer side (end portion) in the paper widthwise direction Y and gradually closed towards the inner side (center) in the paper widthwise direction Y, which is a so-called warhead shape or a semi-elliptic shape. Furthermore, the transverse section of the bottom surface of each concave portion along the paper carrying direction X is formed as a curved surface which is recessed from the front surface 39 toward the rear side (right side in FIG. 9B) as well illustrated in FIG. 9B. Moreover, the transverse section along the paper widthwise direction Y is formed so as to be gradually shallow towards the inner side in the paper widthwise direction Y.

In this embodiment, the maximum span dimension of each of the concave portion 44*a* to 44*g* along the paper carrying direction X is set to approximately 30 mm, the maximum span dimension of each of the same along the paper widthwise direction Y is set to approximately 90 mm, and the maximum depth from the front surface 39 is set to approximately 1.0 mm, and a so-called warhead shape is formed when facing the front surface 39. As indicated by the chain double-dashed lines in FIG. 9A, however, the shape of each of the concave portions 44*a* to 44*g* when facing the front surface 39 may be a so-called semicircular shape.

Moreover, in this embodiment, as well shown in FIG. 9A, a plurality of third suction through holes 45 are formed in the front surface 39 of the platen block 38*a*1 at parts adjacent to the outlines of the seven concave portions 44*a* to 44*g* and the bottom surfaces of the respective concave portions. It is to be noted that reference numeral 45 is given to only some of the third suction through holes in FIG. 9B in order to avoid vexatious complication of the drawing.

It is preferable for the bottom surface of each of the concave portions 44*a* to 44*g* to be machined so as to have the same surface roughness as that of the paper support surface of the front surface 39 of the platen block 38*a*1. In this embodiment, friction reduction processing is likewise applied as with the power support surface, and fluorocarbon resin which is one kind of friction reduction material such as Teflon (registered trademark) is applied to the bottom surface in this embodiment.

In addition, the boundary between the outline of the front shape of each of the concave portions 44*a* to 44*g* and the front surface 39 of the platen block 38*a*1 is subjected to chamfering R processing and rounded in such a manner that the paper 11 carried on the front surface 39 can not be caught thereon.

The transverse section of the front surface 39 along the paper carrying direction X in each space between the concave portions 44*a* to 44*g* may be configured as a waved shape that the two adjacent rounded boundaries in the concave portions 44*a* to 44*g* are continuously formed. Of course, the part of the waved shape which is convex on the front surface side 39 is formed so as not to protrude frontward (ink-jet head side) beyond the front surface 39.

Each of these concave portions 44*a* to 44*g* can be formed by various well-known processing methods. In case of processing using a metal saw in a milling machine, however, it is preferable to match the rotational direction of the metal saw with the paper carrying direction X on the front surface 39 of the platen block 38*a*1. That is because a cutting machining trace generated in the bottom area of the concave portion is consequently formed along the paper carrying direction X and the paper 11 carried on the front surface 39 can be suppressed from being caught on the cutting machining trace on the bottom surface of the concave portion. That is, occurrence of the paper jam can be restrained even in case of relatively rough machining, which leads to reduction in the manufacturing cost of the platen blocks.

Additionally, in each of the concave portions 44*a* to 44*g*, it is revealed that assuring a distance of 10 mm or longer is preferable as a distance of the flat surface (front surface 39) between the adjacent boundaries of the two adjacent concave portions along the paper carrying direction X. That is because the firmness of the paper 11 itself overcomes the suction force generated by the third paper suction holes 45 formed on the flat surface between the adjacent boundaries if the distance of the flat surface between the adjacent boundaries is shorter than the above-described value, and the possibility that the paper 11 can not be appressed against the flat surface (front surface 39) between the adjacent boundaries becomes high even if the third paper suction force is increased.

Further, as shown in FIG. 7B or 9A, it is preferable for the linear portion in the outline of the front shape of each of the concave portions 44*a* to 44*g* which extends in the paper carrying direction X to be positioned on the outer side in the paper widthwise direction Y away from the left end of the widthwise direction of the paper 11 carried on the front surface 39 of the platen block 38*a*1. That is because each of the concave portions 44*a* to 44*g* can further excellently demonstrate its original function with this structure.

Incidentally, as shown in FIG. 9A, on the front surface 39 of the platen block 38*a*1, although the concave portions 44*a* to 44*g* are formed on the paper support surface, which is a part to which the plurality of grooves 40 are not formed, in an area which is opposed to the left end in the widthwise direction of the paper 11 carried on the front surface 39 and extends in the paper carrying direction X, this area will be defined as a first paper support surface portion S1 hereunder. Furthermore, on the paper support surface, an area which is opposed to the center in the widthwise direction of the paper 11 carried on the front surface 39 and in which the concave portions 44*a* to 44*g* are not formed will be defined as a second paper support surface portion S2 hereunder. Incidentally, although the platen block 38*a*7 also has the first paper support surface portion S1 which is an area in which the concave portions 44*a* to 44*g* are formed and which extends in the paper carrying direction X, the explanation thereof will be omitted here.

Moreover, as shown in FIG. 9C, a length L1 of the paper support surface including the curved bottom areas of the concave portions 44*a* to 44*g* in the first paper support surface S1 along the paper carrying direction X is longer than a length L0 of the front surface of the platen in the paper carrying direction.

On the contrary, a linear flat length L2 of the second paper support surface portion S2 which does not include the concave portions 44*a* to 44*g* in the paper is carrying direction X is the same as the length L0 of the front surface of the platen in the paper carrying direction.

That is, a percentage of the length L1 of the paper carrying surface of the first paper support surface portion S1 relative to the predetermined length L0 in the paper carrying direction of the platen 38 is larger than a percentage of the length L2 of the paper carrying surface of the second paper support surface portion S2 relative to the predetermined length L0. That is because the length L1 is longer than the length L2 by the curved portion of the bottom area of each of the concave portions 44*a* to 44*g* formed in the first paper support surface portion S1.

The operation of the ink-jet printer according to this embodiment will now be described i, detail with reference to FIGS. 5 to 10.

When the ink-jet printer starts to operate, the upper roll type long paper 11 above the support frame 10 is drawn out to the nip point between the carrying roller 18 and the carrying pinch roller 20 through the nip point between the front paper feed roller 22 and the front pinch roller 24 and a front paper guide path 26, and the end of the paper 11 is detected by the paper end detection sensor 60 positioned at the upper end of the platen 38. Meanwhile, the carriage 52 is arranged at any one of standby positions on the both outer sides in the horizontal direction of the platen 38 on a pair of movement guide rails 54.

Figure 10B:
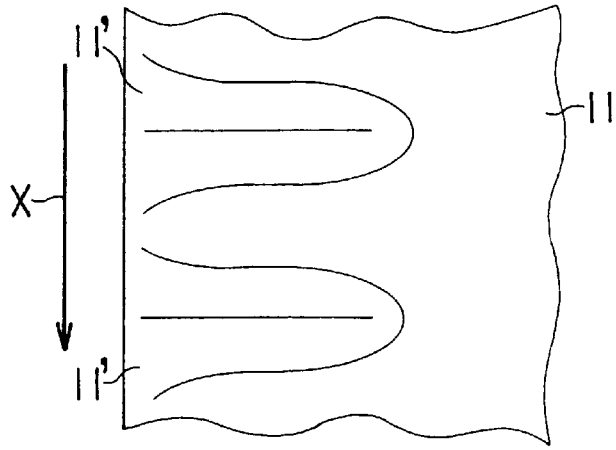
FIG. 10B is an enlarged schematic front view showing a typical shape of the swell which is a factor of paper lift illustrated in FIG. 10A.

As shown in FIGS. 10A and 10B in the enlarged manner, it is often the case that the paper lift 11' due to the continuous swell along the paper carrying direction X is generated at the both ends of the paper 11 in the widthwise direction. Further, when seeing the paper lift 11' from the direction orthogonal to the plane of the paper 11, the paper lift 11' often has a so-called warhead shape or a semi-elliptic shape which gradually spreads from the inner side of the paper 11 toward each of the both ends of the paper 11 in the widthwise direction. A convex portion of the paper lift 11' extends in the widthwise direction Y of the paper 11, and its height often increases toward the end portion of the paper 11 in the widthwise direction Y.

After detection of the paper 11 by the paper end detection sensor 60, the carrying roller 18 and the carrying pinch roller 20 carry the paper 11 to a position immediately before the most upstream end of the nozzle string L of the ink-jet head K for the black ink in the paper carrying direction X. Then, the paper 11 is carried so as to cover the nozzle string of the ink-jet head K on the carriage 52, and thereafter the paper 11 is intermittently carried in units of the length of the nozzle string L. As a result, the paper 11 is led onto the front surface 39 of the platen 38.

When the carrying roller 18 and the carrying pinch roller 20 are intermittently carrying the paper 11, the suction fan 43 is operated. As a result, the negative pressure generated through the first suction through holes 42*a* at the upper end of the platen 38 sucks the paper 11 which has reached the upper end of the front surface 39 onto the front surface 39.

Here, in the second paper support surface portion S2 at the center of the platen 38 to which the concave portions 44*a* to 44*g* are not formed on the front surface 39, the center of the paper 11 in the widthwise direction is sucked by the negative pressure generated through the second suction through holes 42.

Furthermore, in the first paper support surface portion S1 provided at the end of the platen 38 in the paper widthwise direction Y, to which the concave portions 44*a* to 44*g* are formed on the front surface 39, the end of the paper 11 in the widthwise direction is sucked by the negative pressure generated through the third suction through holes 45 on the bottom surfaces and their peripheries of the concave portions 44*a* to 44*g* in addition to the second suction through holes.

The plurality of grooves 40 on the front surfaces 39 of all the platen blocks 38*a*1 to 38*a*7 enable the above-described suction of the paper 11 onto the front surface 39 and, on the other hand, also enable the above-mentioned intermittent carriage of the paper 11 along the front surface 39. Moreover, these grooves 40 avoid lifting of the paper 11 caused when smooth carriage of the paper 11 is prevented by increase in the frictional force generated between the paper 11 and the front surface 39 during intermittent carriage.

In addition, since the width of each of the plurality of grooves 40 in the paper widthwise direction Y is set within 20-fold of the thickness of the paper having the smallest thickness used in this ink-jet printer, the paper 11 is prevented from entering the grooves 40 even in case of the paper having the smallest thickness.

Additionally, as shown in FIG. 9C, in the first paper support surface portion S1 which supports the both ends of the paper 11 in the widthwise direction Y on the platen 38, since the seven curved concave portions 44*a* to 44*g* are formed as described above, the length L1 of the paper support surface in the paper carrying direction X is longer than the length L2 of the paper support surface in the paper carrying direction X in the second paper support surface portion S2 having the flat paper support surface. Therefore, the extended part of the paper 11 generated at the both ends in the widthwise direction Y can be accommodated in the first paper support surface portion S1. That is, even if paper lift 11' such as shown in FIGS. 10A and 10B is generated, the convex portion of the paper lift 11' from the front surface 39 can be sucked to the seven concave portions 44*a* to 44*g* by the negative pressure from the second suction holes 42 and the third suction through holes 45 and becomes the convex portion facing the rear side, and hence the both ends of the paper 11 in the widthwise direction Y do not protrude to the front side (ink-jet head side) beyond the front surface 39 of the platen 38. Further, when the paper 11 is intermittently carried, the paper lift 11' generated at the both ends of the paper 11 are sucked into the seven concave portions 44*a* to 44*g*, and the convex portion of the paper lift 11' does not protrude from the front surface 39 to the front side. Furthermore, since the shape of each of the seven concave portions 44*a* to 44*g* is similar to the shape of the paper lift 11' generated at the both ends of the paper 11 in the widthwise direction Y, the paper lift 11' generated at the both ends of the paper 11 excellently abuts on the bottom area of each of the seven concave portions 44*a* to 44*g*, and is remarkably slidingly sucked to the bottom area.

Incidentally, when the paper lift 11' is not generated at the both ends of the paper 11 in the widthwise direction Y or when the paper lift 11' is very small even if it is generated, the both ends of the paper 11 is just lightly recessed toward the concave portions 44*a* to 44*g* and not brought into contact with the bottom area of each of the concave portions 44*a* to 44*g*. However, when the paper 11 is intermittently carried by the suction force from the third suction through holes 45, the both ends of the paper 11 do not protrude frontward beyond the front surface 39 from the concave portions 44*a* to 44*g*.

Every time the paper 11 which is intermittently carried while being sucked to the front surface 39 of the platen 38 is paused, the carriage 52 moves to the left side or the right side. When the carriage 52 is moving, the respective ink-jet heads K, C, M, LC, LM and Y eject the ink toward the paper 11 based on image information supplied from an external control device (for example, a computer) connected to the ink-jet printer according to this embodiment, and form a desired image on the paper 11. Although the carriage 52 moves to the left side or the right side along the front surface 39 of the platen 38 in order to form an image in this manner, since the paper 11 does not protrude frontward from the front surface 39 irrespective of presence/absence of the paper lift 11' at the both ends in the widthwise direction Y, the carriage 52 does not collide with nor come into contact with the paper 11 supported on the front surface 39. Therefore, the respective ink-jet heads K, C, M, LC, LM and Y on the carriage 52 and their ink ejection nozzle holes in particular are not damaged, and the paper 11 which has collided with each ink-jet head does not produce paper jam between the front surface 39 of the platen 38 and the carriage 52.

Furthermore, since the center of the paper 11 in the widthwise direction is sucked onto the flat second paper support surface portion S2 of the front surface 39 of the platen 38, the distance between each of the ink-jet heads K, C, M, LC, LM and Y on the carriage 52 and the paper 11 is constantly maintained to a predetermined value for maximizing the quality of an image.

Moreover, since the both ends of the paper 11 in the widthwise direction Y is also sucked onto the first paper support surface portion S1, to which the seven concave portions 44*a* to 44*g* are formed, of the front surface 39 of the platen 38, the quality of an image can not be greatly reduced although the distance between each of the six ink-jet heads K to Y on the carriage 52 and the paper 11 is slightly increased.

After the paper 11 on which a desired image is formed is detected by the paper ejection sensor 51 below the platen 38, it is nipped at the nip point between the lower paper ejection roller 48 and the paper ejection pinch roller 50 and further carried downwards at a predetermined speed. After the paper ejection sensor 51 has detected presence of the paper 11 for a predetermined time, namely, after the paper 11 has moved on the front surface 39 of the platen 38 for a predetermined distance in order to record an image, the paper cutter 46 cuts off the paper 11 with a predetermined length on which an image is recorded.

When the front roll type paper 11 runs out, the front paper detection sensor 28 does not detect the paper 11 and the paper end detection sensor 60 does not detect the paper 11, the rear paper feed roller 30 and the rear pinch roller 32 draw out the paper 11 from the rear roll type paper 11 to the nip point between the carrying roller 18 and the carrying pinch roller 20 through the rear paper guide path 34. Moreover, the carrying roller 18 and the carrying pinch roller 20 draw out the paper 11 from the rear roll type paper 11 until the end of the paper 11 is detected by the paper end detection sensor 60 corresponding to the upper end of the platen 38, then stops carriage of the paper 11, and prepares for next recording of an image.

Incidentally, in this embodiment, it is preferable that the number, the arrangement, the shape, the dimension or the like of the seven concave portions 44*a* to 44*g* of each of the two platen blocks 38*a*1 and 38*a*7 at the both ends of the platen 38 in the horizontal direction is designed so as to be substantially equal to the number, the arrangement, the shape, the dimension or the like of the paper lift 11' generated at the both ends in the widthwise direction Y of the paper 11 carried on the front surface 39 of the platen 38. The number, the arrangement, the shape, the dimension or the like of the paper lift 11' generated at the both ends of the paper 11 in the widthwise direction Y can be predicted to some extent based on experiments, statistics or the like in accordance with a material or a dimension, manufacturing processes or a degree of moisture absorption of the paper 11.

Incidentally, even if the number, the arrangement, the shape and the dimension of the concave portions formed on the front surface 39 of the platen 38 do not correspond to the paper lift 11' to be generated, it is in short good enough that the paper lift 11' can be sucked to the concave portions formed to each of the two platen blocks 38*a*1 and 38*a*7, the paper lift 11' does not protrude frontward from the front surface 39 and does not collide with or come into contact with the carriage 52 or the ink-jet heads K to Y.

Therefore, if such conditions are satisfied, the concave portions formed on the front surface 39 of the platen 38 do not have to be formed in accordance with the movement trajectory of each nozzle string L of each of the six ink-jet heads K to Y on the carriage 52.

(Third Embodiment)

Figure 11B:
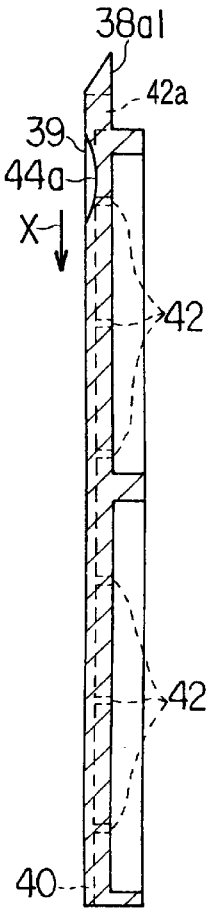
FIG. 11B is a schematic vertical cross-sectional view taken along the line B—B of the platen block depicted in FIG. 11A.
Figure 11A:
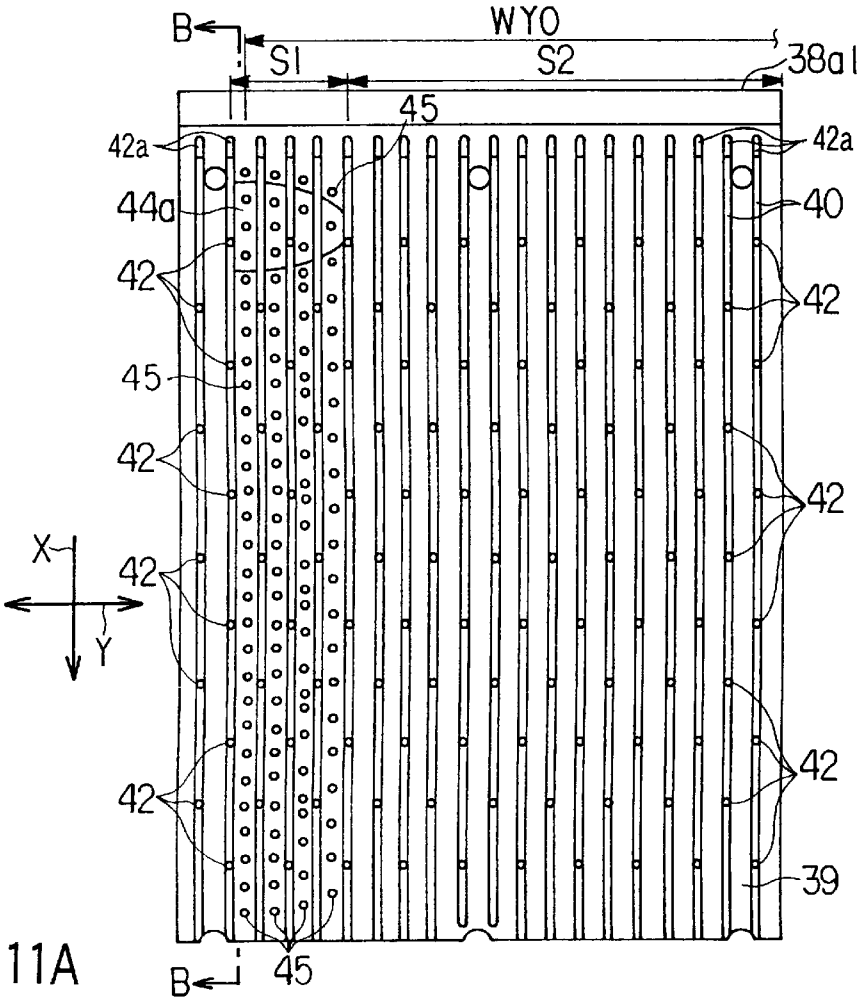
FIG. 11A is an enlarged schematic front view showing a first modification of concave portions formed on the first paper support surface portion corresponding to one end in the widthwise direction of the paper carried on the paper support surface portion in the paper support surface on the front surface of the platen block illustrated in FIG. 9A, and depicts a platen block of an image forming apparatus according to a third embodiment of the present invention.

For example, FIG. 11A and FIG. 11B are a front view and a cross-sectional view showing an example of the platen block 38*a*1 having only one concave portion 44*a* being formed in the first paper support surface portion S1 of the front surface 39 presuming that the above-described three conditions (namely, collision of the paper 11 on the platen 38 with the carriage 52 can be prevented, the paper 11 can be prevented from being jammed between the carriage 52 and the platen 38, and the quality of an image formed on the paper 11 by the ink-jet heads K, C, M, LC, LM and Y on the carriage 52 can not be deteriorated) can be satisfied.

In this embodiment, multiple third suction through holes 45 are formed in a bottom area and its periphery of the concave portion 44*a* in the first paper support surface portion S1. With this structure, the both ends of the paper 11 which is apt to be lifted above the first paper support surface portion S1 because of the paper lift 11' at the both ends can be prevented from being lifted toward the front side beyond the front surface 39, and the paper lift 11' can be absorbed by the concave portion 44*a* in the first paper support surface portion S1.

Further, if there is no concave portion 44*a* in the first paper support surface portion S1 in accordance with the movement trajectory (see FIGS. 7A and 7B) in the paper widthwise direction of the nozzle string L of each of the ink-jet heads K, C, M, LC, LM and Y on the carriage 52, the flat part of the first paper support surface portion S1 other than the concave portion 44*a* corresponds to the movement trajectory of the nozzle string L of each of the six ink-jet heads K to Y.

Therefore, by adopting the platen block 38*a*1 according to the embodiment shown in FIGS. 11A and 11B, the quality of an image formed on the paper 11 supported on the first paper support surface portion S1 is equal to the quality of an image formed on the paper 11 supported on the second paper support surface portion S2.

(Fourth Embodiment)

In general, an ink with a dark color is apt to influence the quality of an image to be formed in the ink-jet printer, and the black ink is darkest and the cyan ink or the magenta ink follows the black ink in the ink-jet printer according to the second embodiment.

Figure 12B:
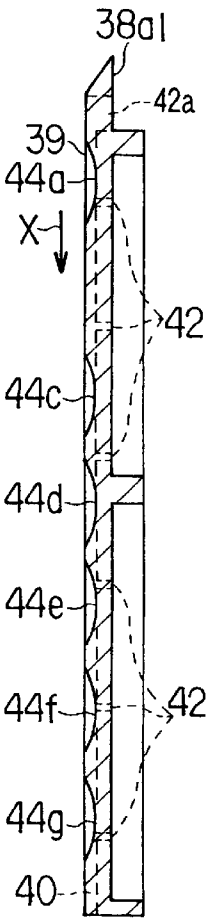
FIG. 12B is a schematic vertical cross-sectional view taken along the line B—B of the platen block illustrated in FIG. 12A.
Figure 12A:
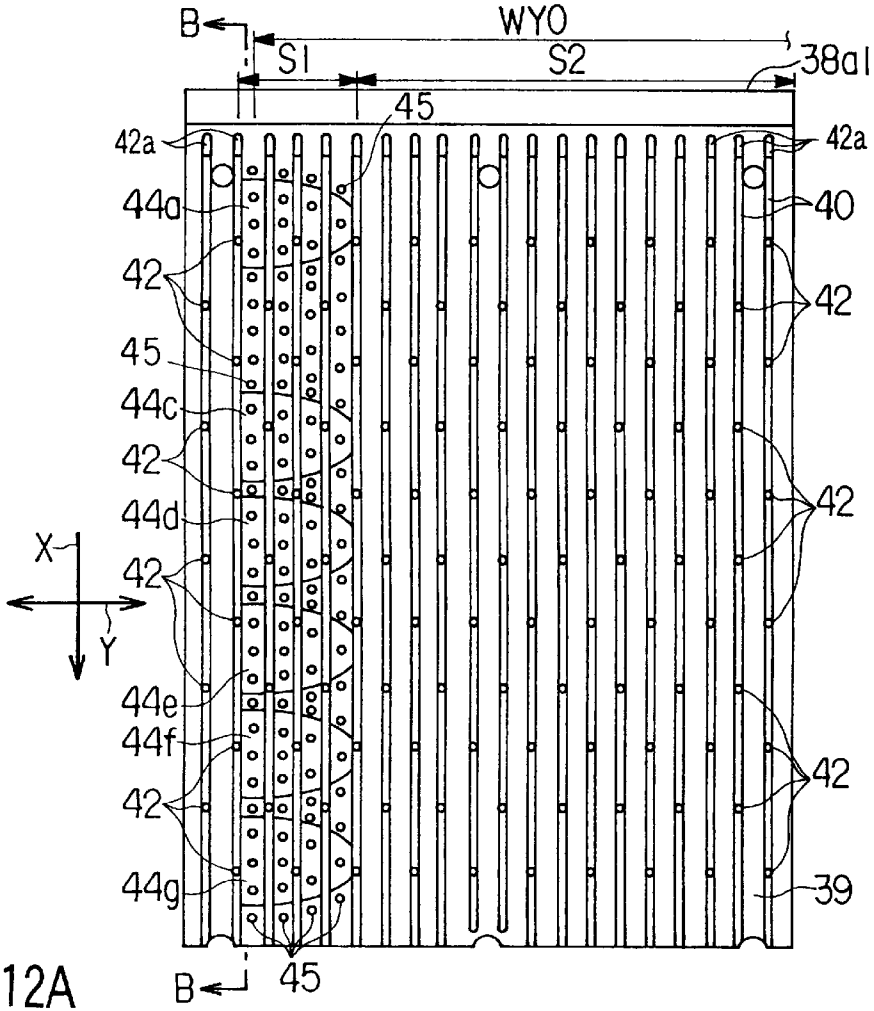
FIG. 12A is an enlarged schematic front view showing a second modification of a plurality of concave portions formed on the first paper support surface portion corresponding to one end in the widthwise direction of the paper carried on the paper support surface on the paper support surface on the front surface of the platen block depicted in FIG. 9A, and illustrates a platen block of an image forming apparatus according to a fourth embodiment of the present invention.

FIGS. 12A and,12B are a front view and a cross-sectional view of the platen block 38*a*1 according to this embodiment.

Here, similarly, presuming that the above-described three conditions (namely, collision of the paper 11 on the platen 38 with the carriage 52 can be prevented, the paper 11 can be prevented from being jammed between the carriage 52 and the platen 38 and the quality of an image formed on the paper 11 by the ink-jet heads K, C, M, LC, LM and Y on the carriage 52 can not be deteriorated) can be satisfied, the concave portion is not formed but only multiple third suction through holes 45 are formed at a position of the movement trajectory (see FIGS. 7A and 7B) in the paper widthwise direction Y of the nozzle string L of the ink-jet head K using the black ink having the highest density among the ink-jet heads K, C, M, LC, LM and Y on the carriage 52. Any other structure of the platen 38*a*1 according to this embodiment is similar to that of the platen 38*a*1 according to the second embodiment shown in FIGS. 9A and 9B.

In this manner, since the concave portion is not formed at a position corresponding to the movement trajectory (see FIGS. 7A and 7B) in the paper widthwise direction Y of the nozzle string L of the ink-jet head K in the first paper support surface portion S1 of the front surface 39 of the platen 38*a*1 according to this embodiment, the quality of an image formed on the paper 11 in the first paper support surface S1 of the front surface 39 of the platen 38*a*1 according to this embodiment can be prevented from lowering by using the black ink in the ink-jet head K.

Furthermore, although the quality of an image formed on the paper 11 in the first paper support surface S1 by any ink other than the black ink slightly lowers in the part of the paper 11 corresponding to the concave portion of the first paper support surface S1, slight reduction in quality of an image is unremarkable when seeing the entire image because it is an image formed by an ink with a relatively low density. Therefore, the paper lift 11' generated at the both ends in the widthwise direction Y of the paper 11 can be sucked into the concave portion, and the overall reduction in quality of an image can be suppressed.

(Fifth Embodiment)

This embodiment is a modification of the fourth embodiment described with reference to FIGS. 12A and 12B.

Figure 13B:
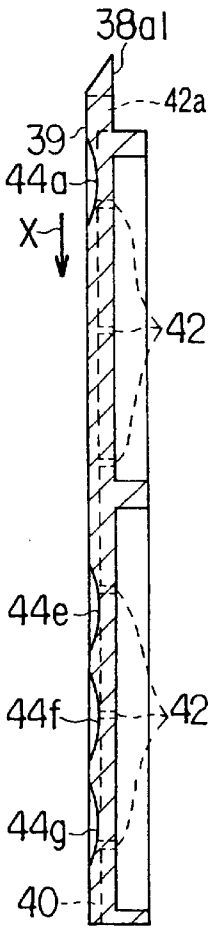
FIG. 13B is a schematic vertical cross-sectional view taken along the line B—B of the platen block depicted in FIG. 13A.
Figure 13A:
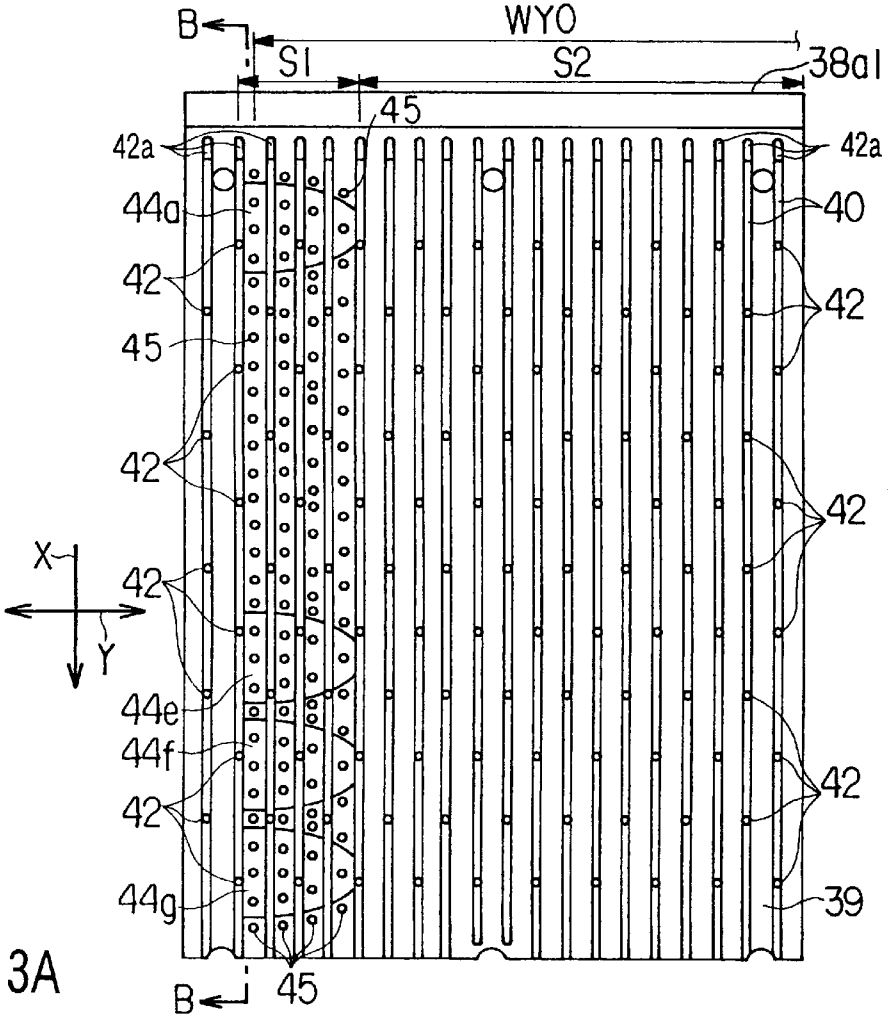
FIG. 13A is an enlarged schematic front view showing a third modification of a plurality of concave portions formed on the first paper support surface portion corresponding to one end in the widthwise direction of the paper carried on the paper support surface in the paper support surface on the front surface of the platen block depicted in FIG. 9A, and illustrates a platen block of an image forming apparatus according to a fifth embodiment (modification of the fourth embodiment) according to the present invention.

FIGS. 13A and 13B are a front view and a cross-sectional view of the platen block 38*a*1 according to this embodiment.

Presuming that the above-described three conditions (namely, collision of the paper 11 on the platen 38 with the carriage 52 can be prevented, the paper 11 can be prevented from being jammed between the carriage 52 and the platen 38 and the quality of an image formed on the paper 11 by the ink-jet heads K, C, M, LC, LM and Y on the carriage 52 can not be deteriorated) can be satisfied, the concave portion is not formed but only multiple third suction through holes 45 are formed in the first paper support surface portion S1 of the front surface 39 at positions corresponding to the movement trajectories (see FIGS. 7A and 7B) in the paper widthwise direction Y of the nozzle string L of the ink-jet head K using the black ink with the highest density among the ink-jet heads K, C, M, LC, LM and Y on the carriage 52 as well as each of the ink-jet heads C and M using the cyan ink or the magenta ink with the second highest density. Any other structure of the platen block 38*a*1 according to this embodiment than that described above is similar to the structure according to the above-mentioned second embodiment shown in FIGS. 9A and 9B.

As described above, in the first paper support surface portion S1, since the concave portion is not formed at the position corresponding to the movement trajectory in the paper widthwise direction Y of the nozzle string L of each of the ink-jet heads K, C and M using the black ink, the cyan ink and the magenta ink with the high density, it is possible to suppress reduction in quality of an image formed on the paper 11 in the first paper support surface portion S1 by the cyan ink and the magenta ink with the relative high density as well as the black ink. As a result, the overall reduction in quality of an image formed on the paper 11 in the paper support surface on the front surface 39 of the platen block 38*a*1 according to this embodiment can become unremarkable. Furthermore, the paper lift 11' generated at the both ends in the widthwise direction Y of the paper 11 on the paper support surface of the front surface 39 of the platen block 38*a*1 can be sucked into the concave portions 44*a*, 44*e*, 44*f* and 44*g* on the first paper support surface portion S1, and lifting toward the front side beyond the front surface 39 can be suppressed, thereby avoiding a problem that the convex portion of the paper lift 11' is brought into contact with the ink-jet heads K, C, M, LC, LM and Y which are adjacent to the paper support surface on the front surface 39 of the platen block 38*a*1.

(Sixth Embodiment)

Figure 14B:
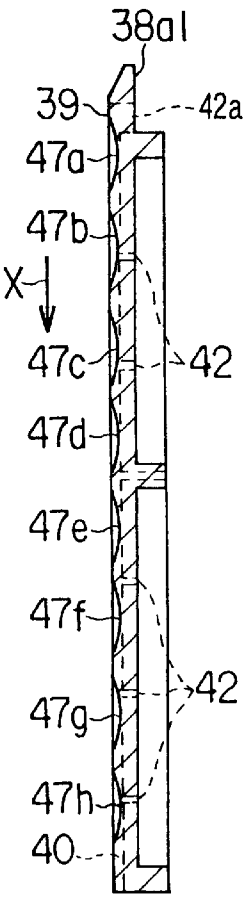
FIG. 14B is a schematic vertical cross-sectional view taken along the line B—B of the platen block depicted in FIG. 14A.
Figure 14A:
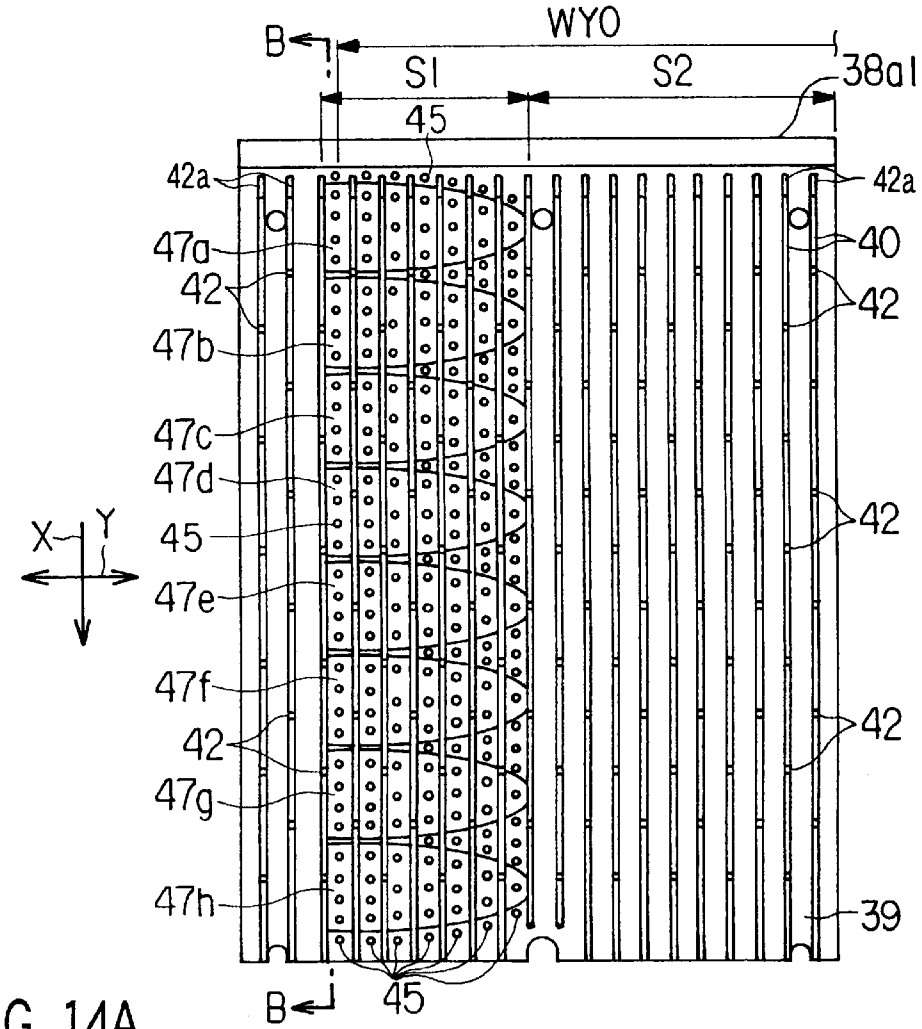
FIG. 14A is an enlarged schematic front view showing a fourth modification of a plurality of concave portions formed on the first paper support surface portion corresponding to one end in the widthwise direction of the paper carried on the paper support surface in the paper support surface on the front surface of the platen block depicted in FIG. 9A, and illustrates a platen block of an image forming apparatus according to a sixth embodiment (modification of the fourth embodiment) of the present invention.

FIGS. 14A and 14B are also a front view and a cross-sectional view showing an example of the platen block 38*a*1 having eight concave portions 47*a*, 47*b*, 47*c*, 47*d*, 47*e*, 47*f*, 47*g* and 47*h* being formed in the first paper support surface portion S1 of the front surface 39 irrespective of the movement trajectory in the widthwise direction Y of the paper 11 of the nozzle string L of each of the six ink-jet heads K to Y assuming that the above-described three conditions (namely, collision of the paper 11 on the platen 38 with the carriage 52 can be avoided, the paper 11 can be prevented from being jammed between the carriage 52 and the platen 38, and the quality of an image formed on the paper 11 by the ink-jet heads K, C, M, LC, LM and Y on the carriage 52 can not be deteriorated) can be satisfied.

In this embodiment, each shape of these concave portions 47*a* to 47*h* is similar to each shape of the concave portions 44*a* to 44*g* formed in the first paper support surface portion S1 of the platen block 38*a*1 according to the second to fifth embodiments mentioned in connection with FIGS. 9A and 9B and FIGS. 11A to 13B, but the former shape is a so-called warhead shape which is long in the paper widthwise direction Y.

In this embodiment, multiple third suction through holes 45 are likewise formed in each bottom area and its periphery of the eight concave portions 47*a* to 47*h* in the first paper support surface portion S1, and these holes suck the both ends in the widthwise direction Y of the paper 11 on the front surface 39 of the platen block 38*a*1 according to this embodiment and prevent the both ends from being lifted above the first paper support surface portion S1.

Moreover, in order to eliminate a remarkable difference between an image formed at the end of the paper 11 supported on the eight concave portions 47*a* to 47*h* in the first paper support surface portion S1 and an image formed at the center of the paper 11 supported on the flat second paper support surface portion S2, each bottom area of the plurality of concave portions 47*a* to 47*h* has a cross section in the paper carrying direction X constituted by a curved surface which is convex toward the rear side as shown in FIG. 14B, and chamfering R processing is applied to the boundary between each bottom area of the concave portions 47*a* to 47*h* and the front surface 39.

It is to be noted that the concave portion having a warhead shape may be formed at a position corresponding to the movement trajectory (see FIGS. 9A and 9B) in the widthwise direction Y of the paper 11 of each nozzle string L of the ink-jet heads K to Y in the first paper support surface portion S1, and may be formed on the further upstream side along the paper carrying direction X in the paper support surface of the front surface 39 of the platen block 38*a*1 away from the position corresponding to the nozzle string L of the ink-jet head K as mentioned in the first embodiment with reference to FIGS. 9A to 9C.

(Seventh Embodiment)

Figure 15B:
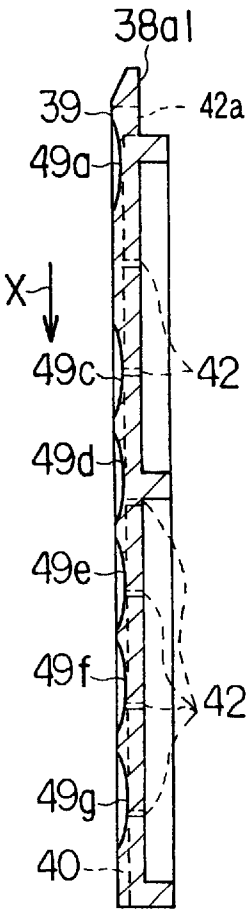
FIG. 15B is a schematic vertical cross-sectional view taken along the line B—B of the platen block illustrated in FIG. 15A.
Figure 15A:
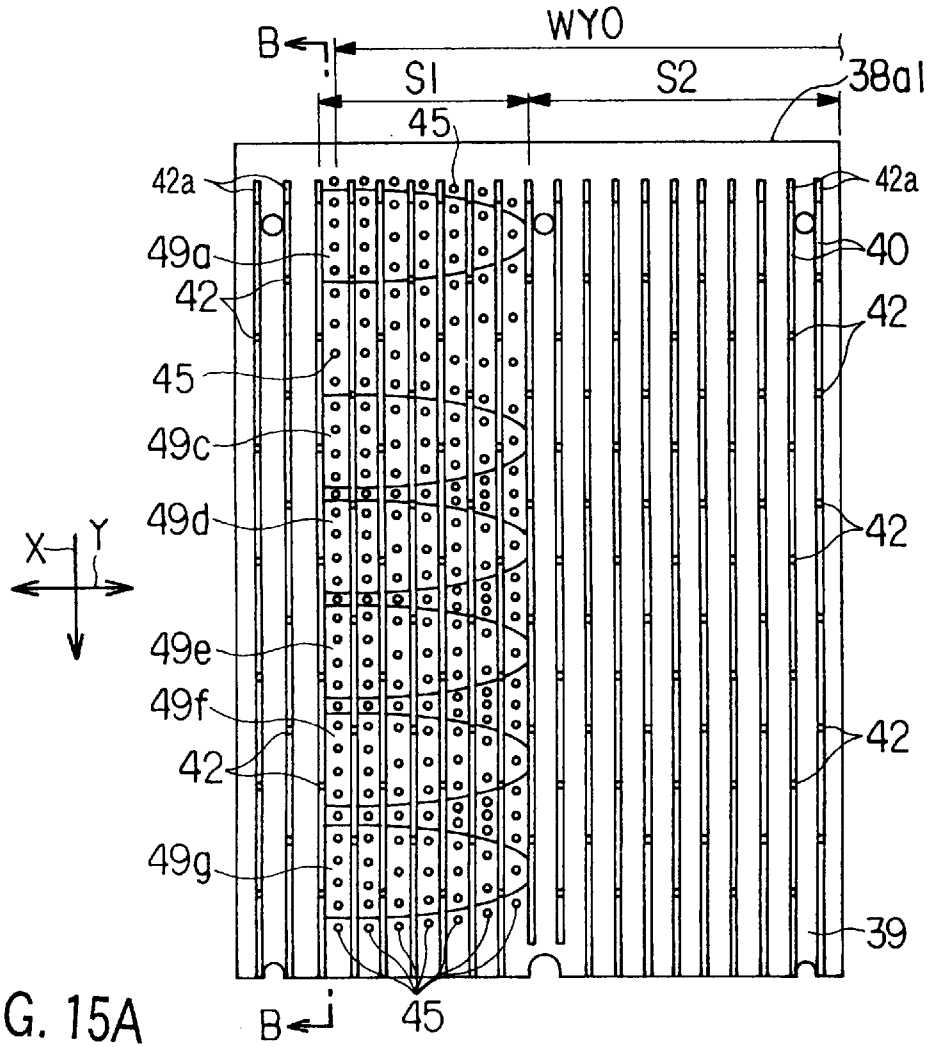
FIG. 15A is an enlarged schematic front view showing a fifth modification of a plurality of concave portions formed on the first paper support surface portion corresponding to one end in the widthwise direction of the paper carried on the paper support surface in the paper support surface on the front surface of the platen block depicted in FIG. 9A, and illustrates a platen block of an image forming apparatus according to a seventh embodiment of the present invention.

FIGS. 15A and 15B are a front view and a cross-sectional view of the platen block 38*a*1 according to this embodiment.

The structure of the platen block 38*a*1 according to this embodiment is formed by combining the structure of the platen block 38*a*1 according to the fourth embodiment mentioned in connection with FIGS. 12A and 12B and the structure of the platen block 38*a*1 according to the sixth embodiment described with reference to FIGS. 14A and 14B. The arrangement or number of the plurality of concave portions 49*a* and 49*c* to 49*g* formed in the first paper support surface portion S1 of the platen block 38*a*1 according to this embodiment is similar to that of the plurality of concave portions 44*a* and 44*c* to 44*g* according to the fourth embodiment mentioned above, and each shape or dimension of the concave portions 49*a* and 49*c* to 49*g* is similar to that of each of the plurality of concave portions 47*a* to 47*g* according to the sixth embodiment.

The effect and advantage in the platen block 38*a*1 according to this embodiment is similar to those in the platen block 38*a*1 according to the fourth embodiment mentioned with reference to FIGS. 12A and 12B.

(Eighth Embodiment)

Figure 16B:
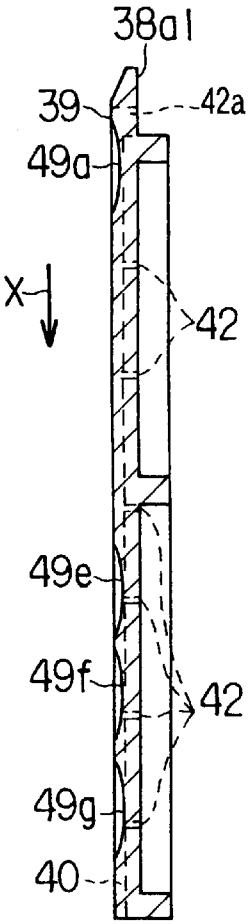
FIG. 16B is a schematic vertical cross-sectional view taken along the line B—B of the platen block illustrated in FIG. 16A.
Figure 16A:
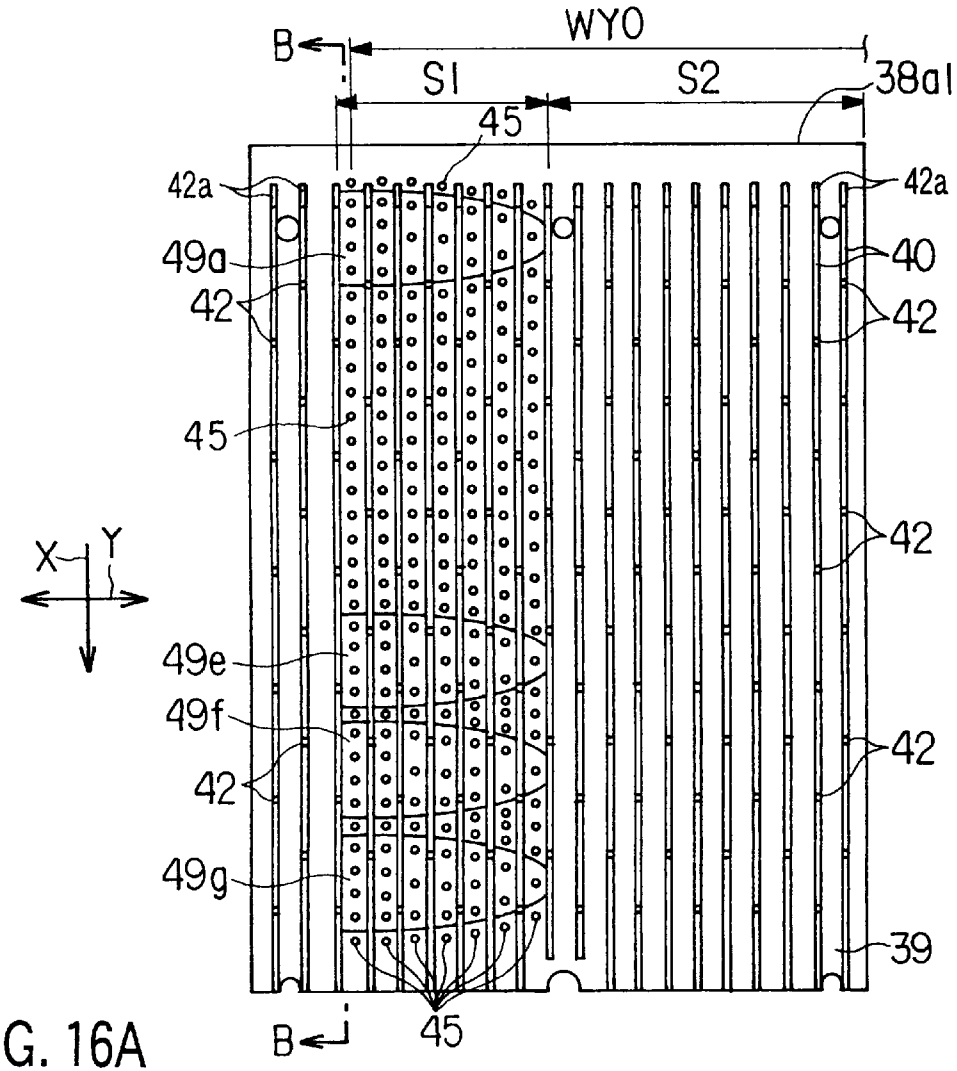
FIG. 16A is an enlarged schematic front view showing a sixth modification of a plurality of concave portions formed on the first paper support surface portion corresponding to one end in the widthwise direction of the paper carried on the paper support surface in the paper support surface on the front surface of the platen block depicted in FIG. 9A, and illustrates a platen block of an image forming apparatus according to an eighth embodiment of the present invention.

FIGS. 16A and 16B are a front view and a cross-sectional view showing the platen block 38*a*1 according to this embodiment.

The structure of the platen block 38*a*1 according to this embodiment is formed by combining the structure of the platen block 38*a*1 according to the fifth embodiment mentioned with reference to FIGS. 13A and 13B and the structure of the platen block 38*a*1 according to the sixth embodiment described in connection with FIGS. 14A and 14B. The arrangement or number of the plurality of concave portions 49*a* and 49*e* to 49*g* formed in the first paper support surface portion S1 of the platen block 38*a*1 according to this embodiment is similar to that of the plurality of concave portions 44*a* and 44*e* to 44*g* according to the fifth embodiment, and each shape or dimension of the concave portions 49*a* and 49*e* to 49*g* is similar to that of the plurality of concave portions 47*a* to 47*g* according to the sixth embodiment.

The effect and advantage in the platen block 38*a*1 according to this embodiment is similar to those in the platen block 38*a*1 according to the fifth embodiment mentioned in connection with FIGS. 13A and 13B.

It is to be noted that the number of the concave portions having the warhead shape which are formed in the first paper support surface portion S1 is not restricted to the value described in each of the foregoing embodiments assuming that the above-described three conditions (namely, collision of the paper 11 on the platen 38 with the carriage 52 can be avoided, the paper 11 can be prevented from being jammed between the carriage 52 and the platen 38 and the quality of an image formed on the paper 11 by the ink-jet heads K, C, M, LC, LM and Y on the carriage 52 can not be deteriorated) can be satisfied. For example, one, two or three concave portions may be formed in the first paper support surface portion S1 irrespective of the movement trajectories (see FIGS. 7A and 7B) of the six nozzle strings L of the ink-jet heads K to Y in the widthwise direction Y of the paper 11 or in accordance with any one, two or three movement trajectories.

(Ninth Embodiment)

In addition, concave portions having a plurality of kinds of shapes may be formed in the first paper support surface portion S1 of the front surface 39 of the platen 38*a*1 irrespective of the movement trajectory (see FIGS. 7A and 7B) of each nozzle string L of the six ink-jet heads K to Y in the widthwise direction Y of the paper 11 or in accordance with any one or a plurality of movement trajectories.

Figure 17B:
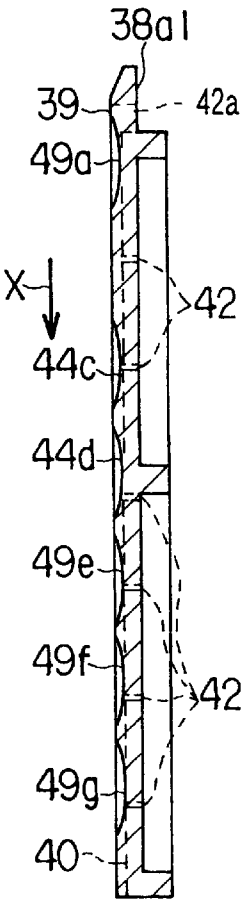
FIG. 17B is a schematic vertical cross-sectional view taken along the line B—B of the platen block depicted in FIG. 17A.
Figure 17A:
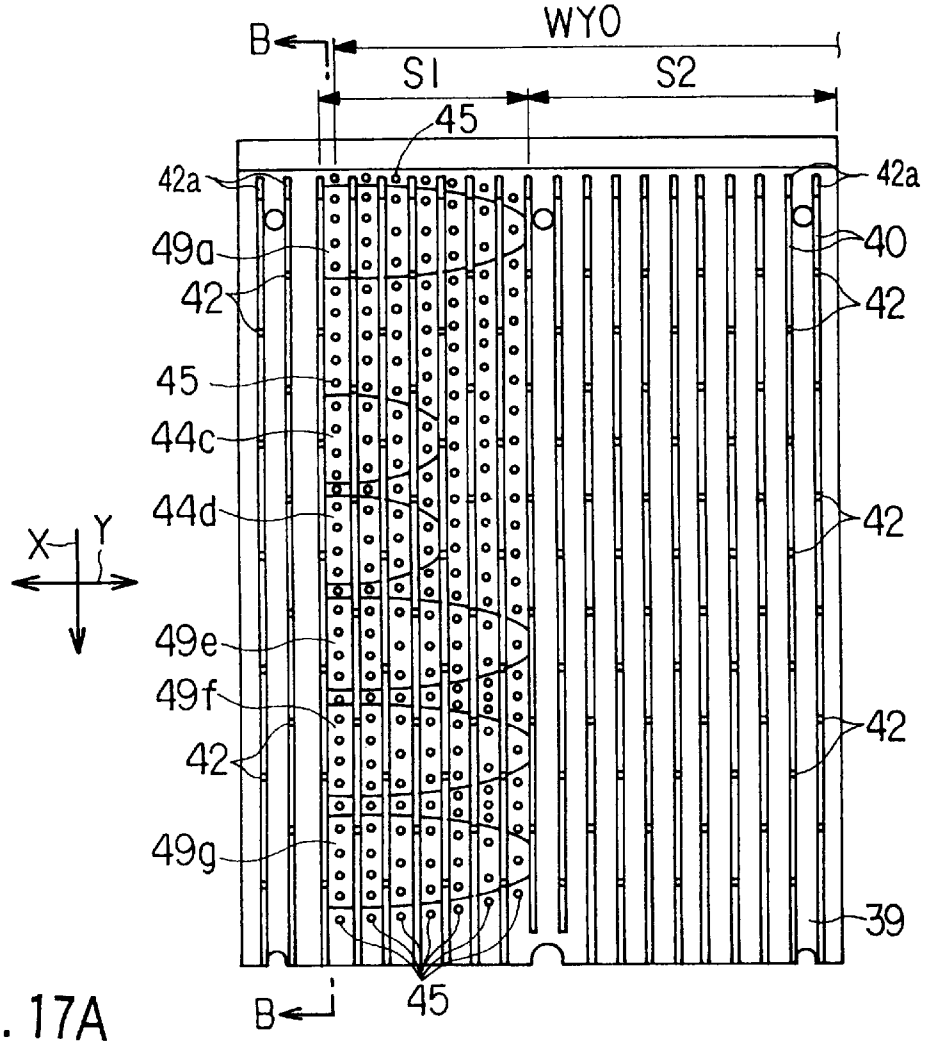
FIG. 17A is an enlarged schematic front view showing a seventh modification of a plurality of concave portions formed on the first paper support surface portion corresponding to one end in the widthwise direction of the paper carried on the paper support surface in the paper support surface on the front surface of the platen block illustrated in FIG. 9A, and illustrates a platen block of an image forming apparatus according to a ninth embodiment of the present invention.

FIGS. 17A and 17B are a front view and a cross-sectional view of the platen 38*a*1 according to a ninth embodiment.

In this embodiment, in the first paper support surface portion S1, the concave portion is not formed at one position corresponding to the movement trajectory in the widthwise direction Y of the paper 11 of the nozzle string L of the ink-jet head K using the black ink having the highest density among the six ink-jet heads K to Y. Further, in the first paper support surface portion S1, the concave portions 44*c* and 44*d* each having a relatively short length in the widthwise direction Y of the paper 11 and a warhead shape are formed at two positions corresponding to the movement trajectories in the widthwise direction Y of the paper 11 of the respective nozzle strings L of the ink-jet heads C and M using the cyan ink or the magenta ink having the density which is the second to the black ink. Furthermore, in the first paper support surface portion S1, the concave portions 49*a*, 49*e*, 49*f* and 49*g* each having a relative long length in the widthwise direction Y of the paper 11 and a warhead shape are formed at three positions corresponding to the respective remaining ink-jet heads LC, LM and Y using light cyan, light magenta and yellow having the relatively low density and at one position on the upstream side away from the position corresponding to the ink-jet head K in the paper carrying direction X.

Each depth of the concave portions 49*a*, 49*e*, 49*f* and 49*g* each having a relatively long length in the widthwise direction Y of the paper 11 and a warhead shape is larger than each depth of the concave portions 44*c* and 44*d* each having a relatively short length in the widthwise direction Y of the paper 11 and a warhead shape.

Moreover, in the first paper support surface portion S1, many suction through holes 45 are formed in an area where the concave portions 44*c*, 44*d*, 49*a*, 49*e*, 49*f* and 49*g* are formed as well as an area where the concave portions 44*c*, 44*d*, 49*a*, 49*e*, 49*f* and 49*g* are not formed.

(10th Embodiment)

Figure 18B:
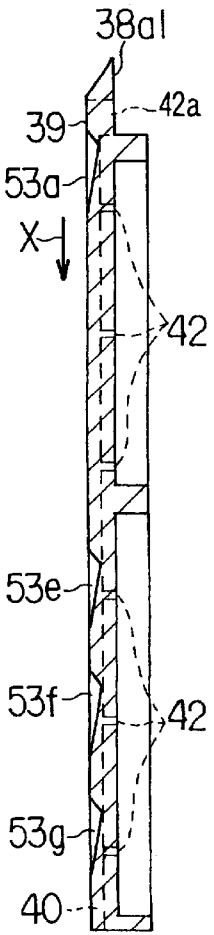
FIG. 18B is a schematic vertical cross-sectional view taken along the line B—B of the platen block depicted in FIG. 18A.
Figure 18A:
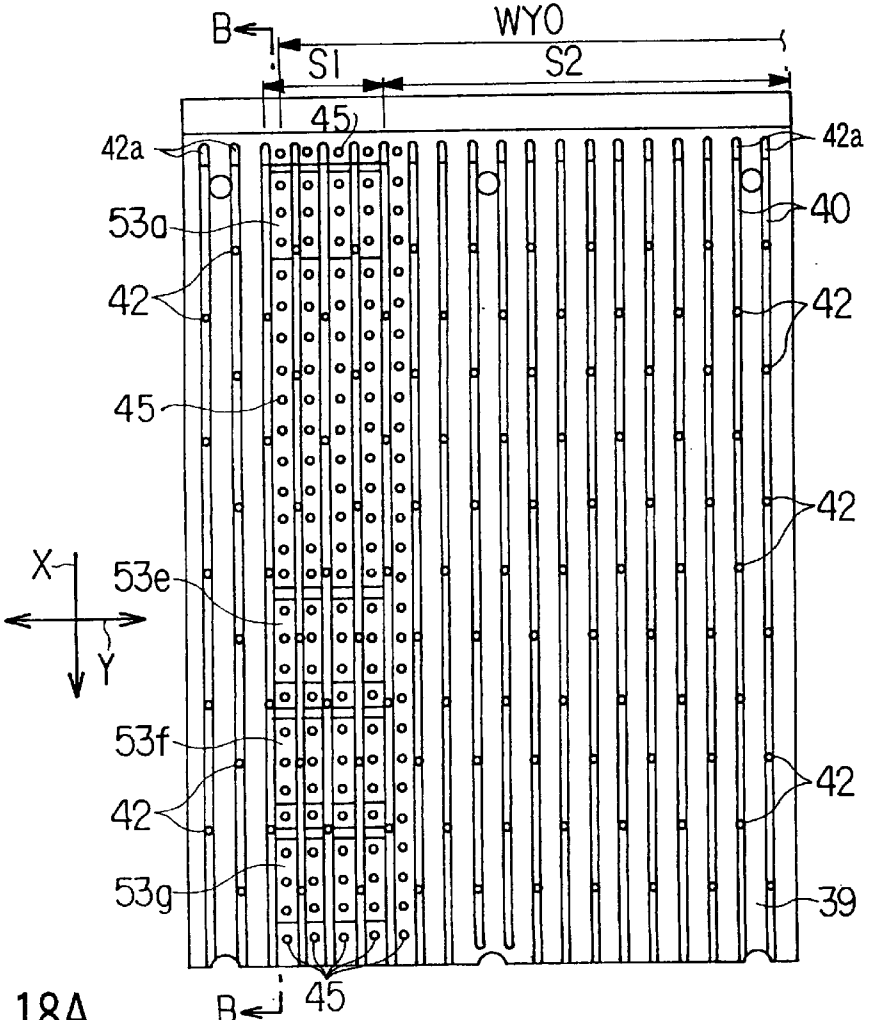
FIG. 18A is an enlarged schematic front view showing an eighth modification of a plurality of concave portions formed on the first paper support surface portion corresponding to one end in the widthwise direction of the paper carried on the paper support surface in the paper support surface of the front surface of the platen block depicted in FIG. 9A, and illustrates a platen block of an image forming apparatus according to a tenth embodiment of the present invention.

FIGS. 18A and 18B are a front view and a cross-sectional view showing the platen 38*a*1 according to a 10th embodiment.

In this embodiment, the shape of the concave portion formed on the first paper support surface portion 1 is rectangular, which can be seen when facing in the direction orthogonal to the paper support surface of the front surface 39 of the platen 38*a*1.

Then, in the first paper support surface portion S1, the above-described concave portion having a rectangular shape is not formed at three positions corresponding to the movement trajectories in the widthwise direction Y of the paper 11 of the respective nozzle strings L of the ink-jet head K using the black ink having the highest density among the six ink-jet heads K to Y and of the ink-jet heads C and M using the cyan ink or the magnet ink whose density is second to the black ink. In the first paper support surface portion S1, however, the rectangular concave portions 53*a*, 53*e*, 53*f* and 53*g* are formed at three positions corresponding to the movement trajectories in the widthwise direction Y of the paper 11 of the respective nozzle strings L of the ink-jet heads LC, LM and Y using the light cyan ink, the light magenta ink and the yellow ink having the relatively low density and at one position on the upstream side corresponding to the ink-jet head K in the paper carrying direction X.

The cross section of each of the rectangular concave portions 53*a*, 53*e*, 53*f* and 53*g* along the carrying direction X of the paper 11 has a V shape that its side positioned on the upstream side is greatly shorter than that positioned on the downstream side in the carrying direction X of the paper 11. This is a structure for causing the paper 11 sucked into each of these concave portions to be carried from the respective concave portions onto the paper support surface of the front surface 39.

In the first paper support surface portion S1, many third suction through holes 45 are formed in an area where the respective rectangular concave portions 53*a*, 53*e*, 53*f* and 53*g* are formed as well as an area where the respective rectangular concave portions 53*a*, 53*e*, 53*f* and 53*g* are not formed.

(11th Embodiment)

Figure 19B:
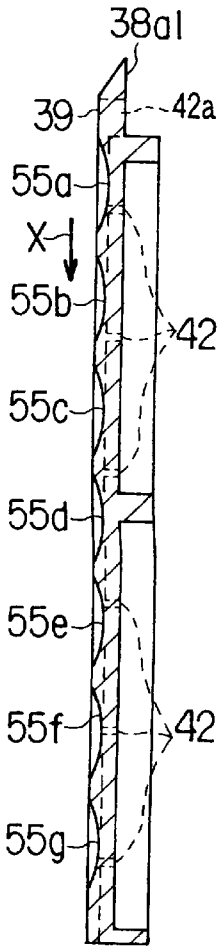
FIG. 19B is a schematic vertical cross-sectional view taken along the line B—B of the platen block depicted in FIG. 19A.
Figure 19A:
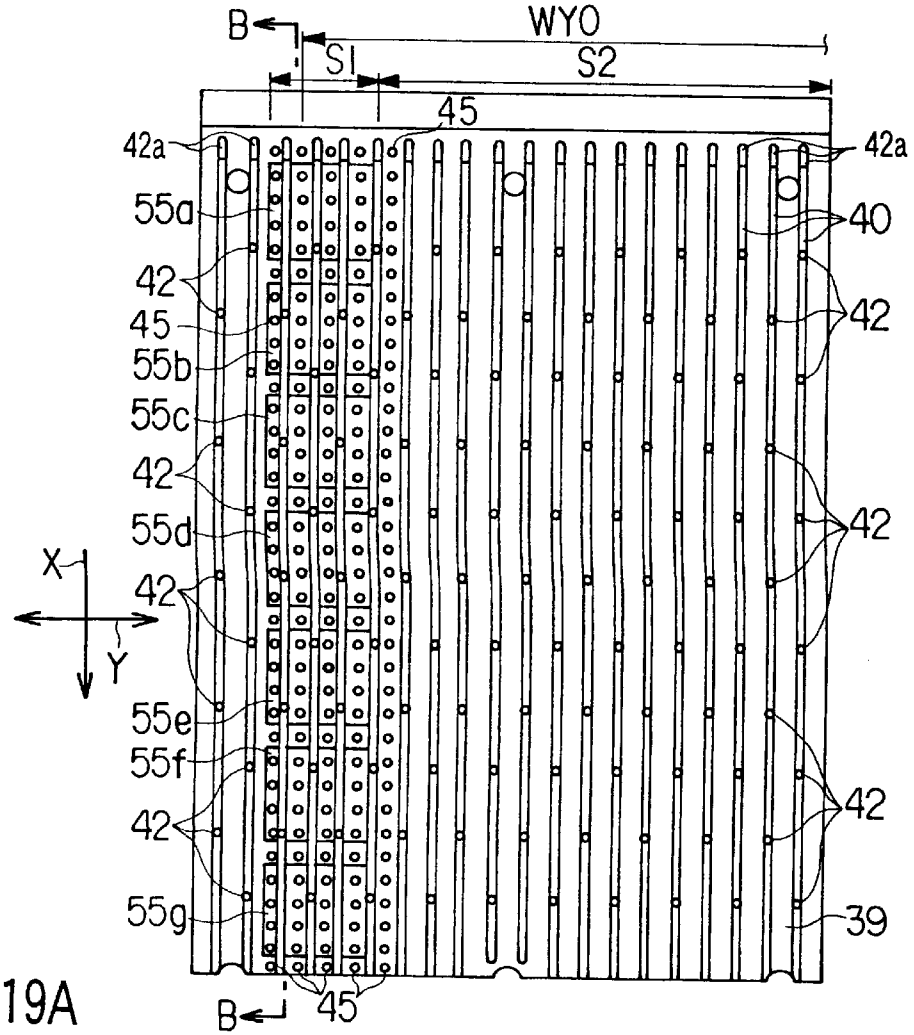
FIG. 19A is an enlarged schematic front view showing a ninth modification of a plurality of concave portions formed on the first paper support surface portion corresponding to one end in the widthwise direction of the paper carried on the paper support surface in the paper support surface on the front surface of the platen block depicted in FIG. 9A, and illustrates a platen block of an image forming apparatus according to an 11th embodiment of the present invention.

FIGS. 19A and 19B are a front view and a cross-sectional view showing the platen 38*a*1 according to an 11th embodiment.

In this embodiment, as similar to the concave portions of the platen 38*a*1 according to the 10th embodiment mentioned in connection with FIGS. 18A and 18B, the shape of the concave portion formed on the first paper support surface portion S1 is rectangular, which can be seen when facing in the direction orthogonal to the paper support surface of the front surface 39 of the platen 38*a*1.

Then, in the first paper support surface portion S1, the rectangular portions 55*a*, 55*b*, 55*c*, 55*d*, 55*e*, 55*f* and 55*g* are formed at positions corresponding to the movement trajectories in the widthwise direction Y of the paper 11 of the respective nozzle strings L of the six ink-jet heads K to Y.

The bottom area of each of these rectangular concave portions 55*a* to 55*g* is constituted by a curved surface having the cross section in the paper carrying direction X being convex toward the rear side of the platen block 38*a*1, as shown in FIG. 19B.

In this embodiment, various modifications are possible. For example, in the first paper support surface portion S1, it is possible not to form the rectangular concave portion having the bottom area which is curved toward the rear side in the convex form as described above at one position corresponding to the movement trajectory in the widthwise direction Y of the paper 11 of the nozzle string L of the ink-jet head K using the black ink with the highest density. Alternatively, it is possible not to form the rectangular concave portions each having the bottom area which is curved toward the rear side in the convex form as mentioned above at two positions corresponding to the movement trajectories in the widthwise direction Y of the paper 11 of the respective nozzle strings L of the ink-jet heads C and M using the cyan ink or the magenta ink with the density which is second to the black ink.

Moreover, in the first paper support surface portion S1, the rectangular concave portions each having the bottom area which is curved toward the rear side in the convex form as mentioned above can be formed at a plurality of positions irrespective of the movement trajectories in the widthwise direction Y of the paper 11 of the respective nozzle strings L of the six ink-jet heads K to Y. The dimension of each rectangular concave portion can be set in many ways. The rectangular concave portions with various dimensions or the concave portions with various shapes other than the rectangular shape can be combined in many ways and formed in the first paper support surface portion S1.

In this embodiment, many third suction through holes 45 are formed in an area where the respective concave portions 55*a* to 55*g* are formed in the first paper support surface portion S1 as well as an area where the respective concave portions 55*a* to 55*g* are not formed in the first paper support surface portion S1. Based on this, the both ends of the paper 11 which are apt to be lifted above the first paper support surface portion S1 because of the paper lift 11' can be prevented from respectively being lifted from an area where the concave portions 55*a* to 55*g* are not formed in the first paper support surface portion S1.

(12th Embodiment)

Each of the ink-jet printers according to the various foregoing embodiments mentioned above is of a type using only paper whose dimension in the widthwise direction Y of the paper 11 is 1372 mm (54 inches). The ink-jet printer which will be described next is of a type which uses various kinds of paper 11 with a variety of dimensions in the widthwise direction Y of the paper 11 and can form a desired image on each of these types of paper 11. This ink-jet printer can use various kinds of paper having the width of 1270 mm (50 inches), 1067 mm (42 inches), 914 mm (36 inches), 840 mm (A0 size paper) or 594 mm (A1 size paper).

Figure 20:
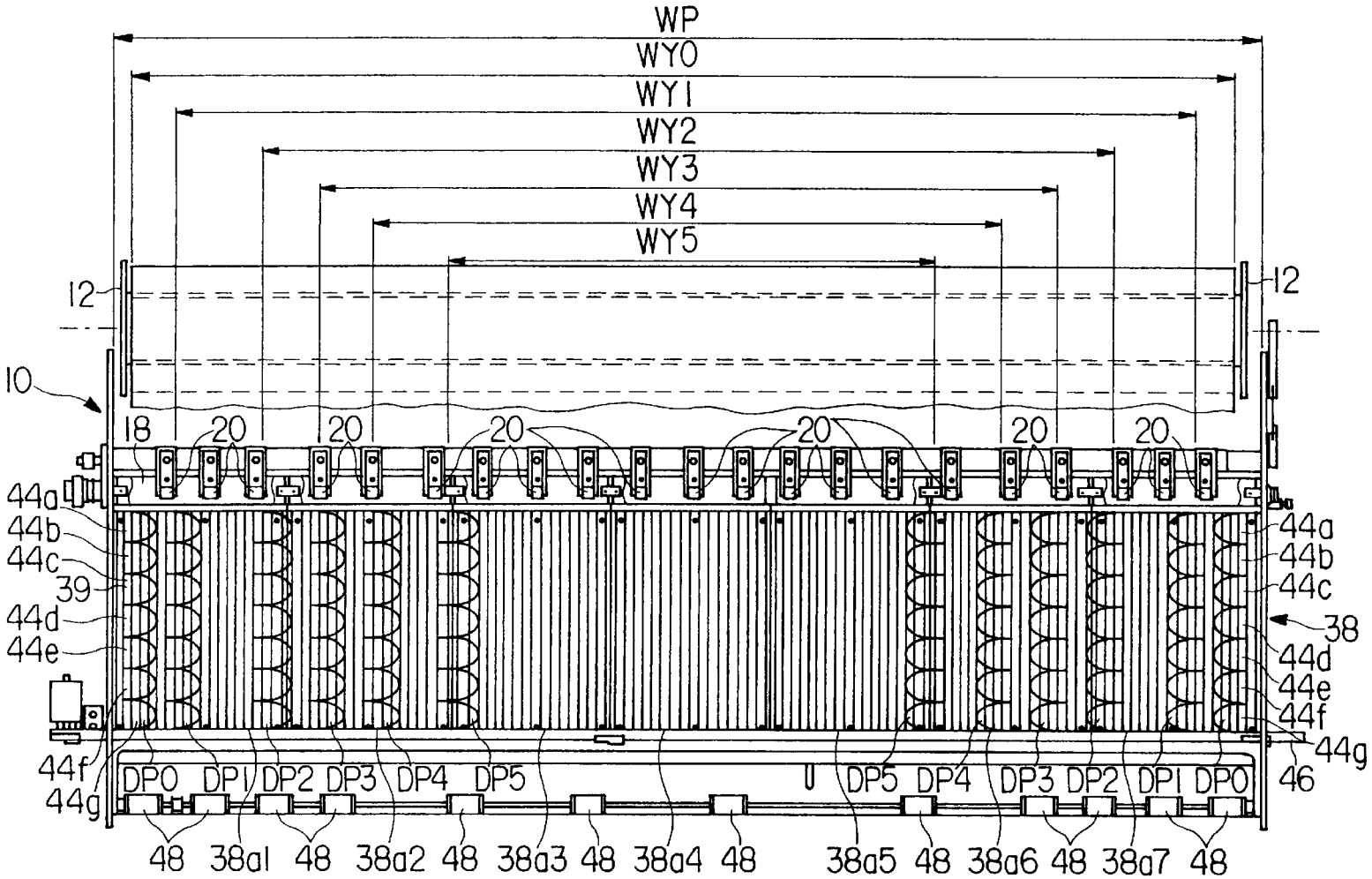
FIG. 20 is a schematic front view showing various concave portions formed on a plurality of pairs of first paper support surface portions corresponding to respective both ends of paper sheets with various widthwise dimensions when using the paper sheets with various widthwise dimensions in the paper support surface on the front surface of the platen depicted in FIG. 6, and illustrates a platen block of an image forming apparatus according to a 12th embodiment of the present invention.

FIG. 20 schematically shows constructions of the platen and its periphery of the ink-jet printer which can use paper with six types of widths.

On the paper support surface of the front surface 39 of this platen 38 are formed six first paper support surface portions DP0, DP1, DP2, DP3, DP4 and DP5 used for supporting the both ends in the widthwise direction Y of each paper in accordance with the six width dimensions of paper to be used WY0 (1372 mm), WY1 (1270 mm), WY2 (1067 mm), WY3 (914 mm), WY4 (840 mm) and WY5 (594 mm). A plurality of concave portions each of which is opened toward the outer side in the widthwise direction Y of each paper and has a warhead shape are formed in each of the six first paper support surface portions DP0, DP1, DP2, DP3, DP4 and DP5 along the paper carrying direction X.

The seven warhead-shaped concave portions and many third through suction holes are formed in each of the first paper support surface portions DP0 to DP5 along the paper carrying direction X. It is to be noted that arrangement of these seven concave portions in the paper carrying direction X is similar to that of the concave portions 44*a* to 44*g* in the first embodiment mentioned in connection with FIGS. 9A and 9B.

By using such a platen 38, even if any paper is used among various kinds of paper 11 having a variety of the widthwise dimensions WY0, WY1, WY2, WY3, WY4 and WY5, the paper lift generated at both ends in the widthwise direction Y of the paper 11 can be sucked into the plurality of concave portions formed in each of the six first paper support surface portions DP0, DP1, DP2, DP3, DP4 and DP5 of the front surface 39 of the platen 38 in accordance with the both ends in the widthwise direction Y of each of various kinds of paper 11. As a result, even if the paper lift is generated at the both ends in the widthwise direction Y of the paper 11 which has been used, this paper lift can be prevented from protruding frontward beyond the front surface 39 of the platen 38, and the paper lift can be prevented from colliding with the ink-jet heads K, C, M, LC, LM and Y arranged in contiguity with the front surface 39 of the platen 38 in order to avoid damages to the respective fine ink-jet nozzle holes of the ink-jet heads K, C, M, LC, LM and Y. Also, it is also possible to prevent the paper lift from causing jamming between the front surface 39 of the platen 38 and the ink-jet heads K, C, M, LC, LM and Y.

In this embodiment, assuming that the above-described three conditions (namely, collision of the paper 11 on the platen 38 with the carriage 52 can be avoided, the paper 11 can be prevented from being jammed between the carriage 52 and the platen 38, and the quality of an image formed on the paper 11 by the ink-jet heads K, C, M, LC, LM and Y on the carriage 52 can not be deteriorated) can be satisfied, the shape, dimension, number and arrangement of the concave portions formed in each of the six first paper support surface portion DP0 to DP5 can be appropriately set.

(13th Embodiment)

Figure 21B:
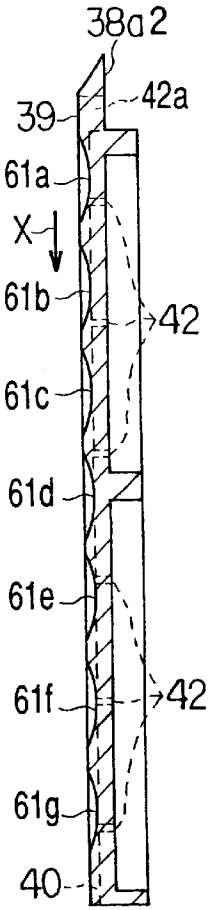
FIG. 21B is a schematic vertical cross-sectional view taken along the line B—B of the platen block illustrated in FIG. 21A.
Figure 21A:
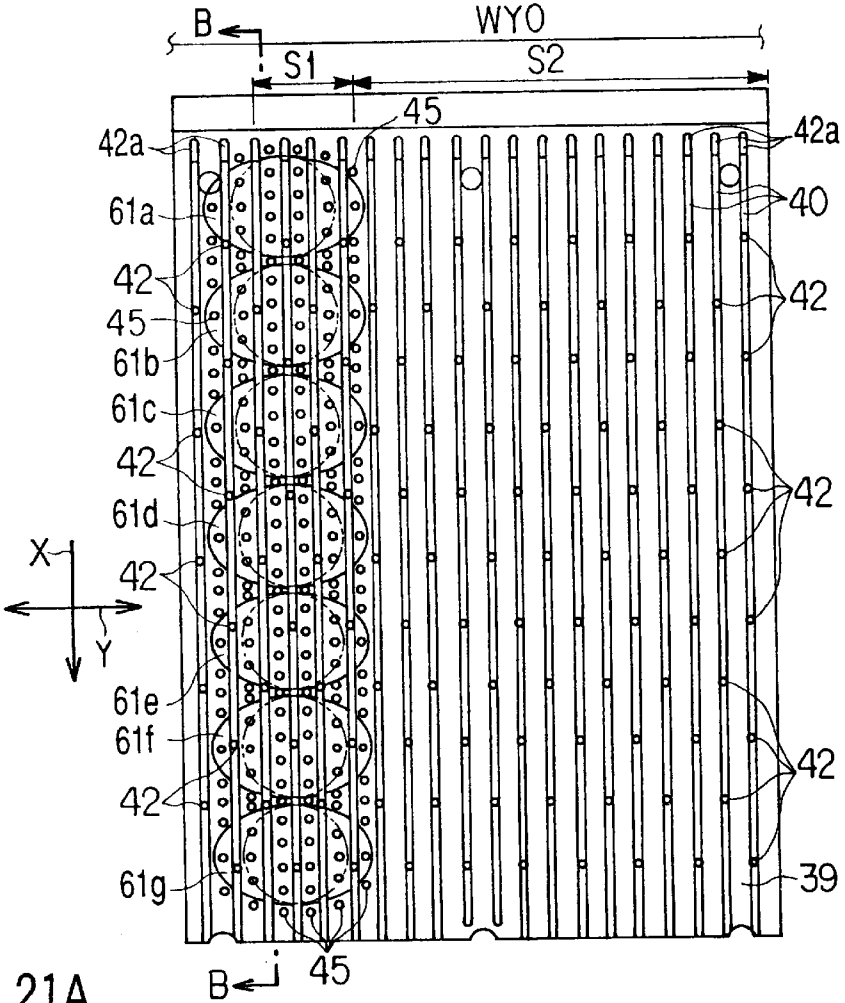
FIG. 21A is an enlarged schematic front view showing a 10th modification of a plurality of concave portions formed on the first paper support surface portion corresponding to one end in the widthwise direction of the paper carried on the paper support surface in the paper support surface on the front surface of the platen block depicted in FIG. 9A, and illustrates a platen block of an image forming apparatus according to a 13th embodiment of the present invention.

FIGS. 21A and 21B show a shape of the concave portions which is preferable when formed in each of five first paper support surface portions DP1 to DP5 provided on the inner side of the platen 38 among the six first paper support surface portions DP0 to DO5.

When the ink-jet printer provided with the platen 38 to which the six first paper support surface portions DP0 to DP5 are formed uses the paper 11 having the widthwise dimension of WY0, not only the both ends in the widthwise direction X of the paper 11 but also the intermediate portion in the widthwise direction Y of the paper 11 can be supported by the first paper support surface portions DP1 to DP5. At this moment, if the paper 11 slightly extends in the paper carrying direction X in the intermediate portion in the widthwise direction Y of the paper 11, only the extended part is sucked into any concave portion of the first paper support surface portions DP1 to DP5. That is, if the shape of each concave portion of the first paper support surface portions DP1 to DP5 is a warhead shape such as shown in FIG. 20, the extended part of the paper to be sucked is sucked along the warhead shape of the concave portion.

When the concave portion has a warhead shape, since there is a linear boundary along the paper carrying direction X between the concave portion and the front surface 39, the extended part of the paper to be sucked into the concave portion may possibly suddenly bend at this linear boundary depending on a material of the paper. When an image is formed on the paper 11 on the platen 38 in an area where bending of the paper is generated by the ink-jet heads K, C, M, LC, LM and Y, the quality of an image is considerably deteriorated in the bent area of the paper 11.

When elliptic concave portions 61*a* to 61*g* such as indicated by the solid lines in FIGS. 21A and 21B, each of which portion is symmetrical and has no linear part along the paper carrying direction X, or circular concave portions as indicated by chain double-dashed lines in FIGS. 21A and 21B are formed in the five first paper support surface portions DP1 to DP5 formed on the inner side of the platen 38, the linear bent boundary is not generated even if the extended part of the intermediate portion of the paper 11 is sucked into such concave portions. Therefore, the quality of an image can be prevented from being deteriorated at the extended part in the intermediate portion of the sucked paper 11.

(14th Embodiment)

FIG. 22 shows a pair of concave portions 71*a* and 71*b* formed in the first paper support surface portion corresponding to one of the both ends in the widthwise direction of the paper supported by this platen in the paper support surface of the platen used in the image forming apparatus according to the 14th embodiment of the present invention.

In this embodiment, a pair of the concave portions 71*a* and 71*b* are arranged on the both sides (namely, upstream side and downstream side) of the paper carrying direction X with respect to the movement trajectories of the plurality of ink-jet heads K, C, M, LC, LM and Y of the image forming unit IFU (see FIG. 7A) in the first paper support surface portion.

The further advantages and modifications can be readily derived by persons skilled in this technical field. Therefore, the present invention in the broader concept is not restricted to a specific detail or a typical embodiment. Accordingly, various modifications may be carried out without departing from the sprit or the scope of the general concept of the present invention as defined by the appended claims or their equivalents.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus comprising:

a paper carrying unit which carries a paper;

a paper support unit which has a paper support surface and which supports the paper carried by the paper carrying unit, on the paper support surface; and an image forming unit which is arranged to face the paper on the paper support surface of the paper support unit, and which forms an image on the paper on the paper support surface, wherein the paper support unit has a plurality of grooves formed in the paper support surface along a paper carrying direction of the paper carried on the paper support surface, and a plurality of suction holes provided in the plurality of grooves, and wherein positions of suction holes in two adjacent grooves among the plurality of grooves are staggered in the paper carrying direction.

2. The image forming apparatus according to claim 1, wherein the paper support surface of the paper support unit is applied with a friction decreasing treatment.

3. The image forming apparatus according to claim 1, wherein the paper support unit has a chamber provided on an opposite side of the paper support unit to the image forming unit and divided into a plurality of parts in a direction in which the paper is carried along the paper support surface of the paper support unit, and has a plurality of suction units each of which is provided to each of the divided parts of the chamber and suctions the paper onto the paper support surface by forming a negative pressure in each of the divided parts of the chamber and drawing air through the suction holes.

4. An image forming apparatus comprising:

a paper carrying unit which carries a paper;

a paper support unit which has a paper support surface, and which supports the paper carried by the paper carrying unit on the paper support surface; and an image forming unit which is arranged to face the paper on the paper support surface of the paper support unit, and which forms an image on the paper on the paper support surface, wherein the paper support unit has a plurality of suction holes formed in the paper support surface, a chamber provided on an opposite side of the paper support unit to the image forming unit and divided into a plurality of parts in a direction in which the paper is carried on the paper support surface of the paper support unit, and has a plurality of suction units each of which is provided to each of the divided parts of the chamber and suctions the paper onto the paper support surface of the paper support unit by forming a negative pressure in each of the divided parts of the chamber and drawing air through the suction holes.

5. The image forming apparatus according to claim 4, wherein the chamber is constituted by the paper carrying unit and the paper support unit.

6. The image forming apparatus according to claim 4, wherein the image forming apparatus further comprises a control unit which controls a suction negative pressure generated by each of the suction units.

7. The image forming apparatus according to claim 6, wherein the paper support unit includes a paper detection unit which detects a presence and an absence of the paper, and wherein the control unit controls the suction negative pressure generated by each of the suction units on the basis of an output from the paper detection unit.

8. The image forming apparatus according to claim 7, wherein the paper detection unit includes paper detection sensors on an upstream-side and a downstream-side of the paper support unit in the carrying direction of the paper, and wherein the control unit controls the suction negative pressure generated by each of the suction units so that the suction negative pressure becomes large when the paper detection sensor on the upstream-side detects the paper, and controls the suction negative pressure generated by each of the suction units so that the suction negative pressure becomes small when the paper detection sensor on the downstream-side detects the paper.

9. The image forming apparatus according to claim 6, wherein the control unit has an operation portion used for inputting a type of paper to be used in the image forming apparatus, and wherein the control unit controls the magnitude of the suction negative pressure generated by each of the suction units in accordance with the type of paper input from the operation portion.

10. The image forming apparatus according to claim 6, wherein the control unit controls the number of the suction units to be driven among the plurality of suction units so that the magnitude of the suction negative pressure in the chamber is changed.

11. The image forming apparatus according to claim 6, wherein the magnitudes of the suction negative pressures generated by the plurality of suction units are different from each other, and wherein the control unit selects at least one of the suction units to be driven among the plurality of suction units so that the magnitude of the suction negative pressure in the chamber is changed.

12. The image forming apparatus according to claim 6, wherein the control unit controls the suction negative pressure generated by the suction units so that the suction negative pressure in the chamber is weakened or stops while the paper is carried by the carrying unit, and wherein the control unit controls the suction negative pressure generated by the suction units so that the suction negative pressure in the chamber is strengthened while an image is formed on the paper by the image forming unit.

13. An image forming apparatus comprising:

a paper carrying unit which carries a paper in a predetermined direction;

a paper support unit which has a paper support surface supporting the paper carried by the paper carrying unit, and which has a predetermined length in the predetermined direction; and an image forming unit which forms an image on the paper on the paper support surface of the paper support unit, wherein the paper support surface of the paper support unit has first paper support portions which correspond to both ends of the paper in a widthwise direction of the paper and a second paper support portion which corresponds to an intermediate part of the paper between the both ends in the widthwise direction of the paper, the first paper support portions supporting the both ends and the second paper support portion supporting the intermediate part of the paper while the paper is carried by the paper carrying unit in the predetermined direction, and wherein a percentage of a length of the paper support surface along each of the first paper support portions in the predetermined direction relative to the predetermined length of the paper support unit in the predetermined direction is lager than a percentage of a length of the paper support surface along the second paper support portion in the predetermined direction relative to the predetermined length of the paper support unit in the predetermined direction.

14. The image forming apparatus according to claim 13, wherein a plurality of concave portions are formed in each of the first paper support portions, the concave portions being separated from each other in the predetermined direction.

15. The image forming apparatus according to claim 14, wherein a shape of each of the concave portions, which can be seen when facing the paper support surface, is one of a warhead shape, a semi-circular shape, a circular shape, and a rectangular shape.

16. The image forming apparatus according to claim 15, wherein a bottom area of each of the concave portions is a curved surface.

17. The image forming apparatus according to claim 13, wherein a plurality of suction holes are formed in each of the first and second paper support portions, wherein the image forming apparatus further comprises a suction unit which sucks the paper onto the first and second paper support portions through the suction holes, and wherein the number of the suction holes formed in the first paper support portions is larger than the number of the suction holes formed in the second paper support portion.

18. The image forming apparatus according to claim 17, wherein at least one of the suction holes is formed in the bottom area of each of the concave portions formed in the first paper support portions.

19. The image forming apparatus according to claim 13, wherein a plurality of suction holes are formed in each of the first and second paper support portions, wherein the image forming apparatus further comprises a suction unit which suctions the paper onto the first and second paper support portions through the suction holes, and wherein the paper suction force on the first paper support portions is stronger than the paper suction force on the second paper support portion.

20. The image forming apparatus according to ciaim 19, wherein at least one of the suction holes is formed in the bottom area of each of the concave portions formed in the first and second paper support portions.

21. The image forming apparatus according to claim 13, wherein the paper carrying unit can carry a plurality of types of papers having widths different from each other, and wherein the first paper support portions are formed on the paper support unit to correspond to both ends of each of the plurality of types of papers in the widthwise direction.

* * * * *